US010139757B2

(12) United States Patent
Takahashi et al.

(10) Patent No.: US 10,139,757 B2
(45) Date of Patent: Nov. 27, 2018

(54) PRESSING APPARATUS, IMAGE FORMING APPARATUS, METHOD FOR CONTROLLING PRESSING APPARATUS, AND COMPUTER-READABLE STORAGE MEDIUM

(71) Applicants: Minoru Takahashi, Kanagawa (JP); Tetsuya Sonoda, Kanagawa (JP); Ken Oikawa, Kanagawa (JP)

(72) Inventors: Minoru Takahashi, Kanagawa (JP); Tetsuya Sonoda, Kanagawa (JP); Ken Oikawa, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/308,133

(22) PCT Filed: May 11, 2015

(86) PCT No.: PCT/JP2015/064122
§ 371 (c)(1),
(2) Date: Nov. 1, 2016

(87) PCT Pub. No.: WO2015/178325
PCT Pub. Date: Nov. 26, 2015

(65) Prior Publication Data

US 2017/0052483 A1 Feb. 23, 2017

(30) Foreign Application Priority Data

May 20, 2014 (JP) ..... 2014-104730
Mar. 13, 2015 (JP) ..... 2015-050867

(51) Int. Cl.
*G03G 15/16* (2006.01)

(52) U.S. Cl.
CPC ..... *G03G 15/161* (2013.01); *G03G 15/168* (2013.01); *G03G 15/1685* (2013.01); *G03G 2221/1654* (2013.01)

(58) Field of Classification Search
CPC ..... G03G 15/168
See application file for complete search history.

(56) References Cited

U.S. PATENT DOCUMENTS 8,422,037 B2 4/2013 Hodoshima et al.
2007/0110487 A1 5/2007 Kim et al.
(Continued)

FOREIGN PATENT DOCUMENTS

JP 2005-266654 9/2005
JP 2007-163692 6/2007
(Continued)

OTHER PUBLICATIONS

Extended European Search Report dated May 4, 2017.
(Continued)

*Primary Examiner* — Ryan Walsh
(74) *Attorney, Agent, or Firm* — Harness, Dickey & Pierce, P.L.C.

(57) ABSTRACT

A pressing apparatus includes a presser including a second member configured to come close to or separate from a first member; an elastic member configured to apply force in a direction in which the second member comes close to the first member to the presser, the elastic member being mounted on the presser; an actuator configured to apply force in a direction in which the second member comes close to the first member or separates from the first member to the presser, the actuator being mounted on the presser; an acquirer configured to acquire a parameter containing at least one of a position of the presser, a speed of the presser, and force applied by the actuator to the presser; and a
(Continued)

controller configured to feedback-control the actuator based on the parameter.

15 Claims, 17 Drawing Sheets

(56) References Cited

U.S. PATENT DOCUMENTS

| | | | | |
|---|---|---|---|---|
| 2009/0207461 | A1 | 8/2009 | Hodoshima et al. | |
| 2009/0220277 | A1 | 9/2009 | Andoh et al. | |
| 2010/0034565 | A1 | 2/2010 | Ashikawa et al. | |
| 2011/0158690 | A1 | 6/2011 | Mimbu et al. | |
| 2013/0121715 | A1 | 5/2013 | Ashikawa et al. | |
| 2015/0086239 | A1* | 3/2015 | Inuzuka ..... | G03G 15/1615 399/121 |
| 2017/0031294 | A1* | 2/2017 | Oikawa ..... | G03G 15/6529 |

FOREIGN PATENT DOCUMENTS

| | | |
|---|---|---|
| JP | 2008-139749 | 6/2008 |
| JP | 2009-222112 A | 10/2009 |
| JP | 2010-026351 | 2/2010 |
| JP | 2010-055069 | 3/2010 |
| JP | 2011-133653 | 7/2011 |
| JP | 4807752 | 8/2011 |
| JP | 2011-248320 | 12/2011 |
| JP | 5049575 | 7/2012 |
| JP | 5152647 B2 | 2/2013 |
| JP | 2016-001299 | 1/2016 |

OTHER PUBLICATIONS

International Search Report dated Jul. 14, 2015 in PCT/JP2015/064122 filed on May 11, 2015.

Korean Office Action and English translation thereof dated May 28, 2018.

* cited by examiner

PRESSING APPARATUS, IMAGE FORMING APPARATUS, METHOD FOR CONTROLLING PRESSING APPARATUS, AND COMPUTER-READABLE STORAGE MEDIUM

TECHNICAL FIELD

The present invention relates to a pressing apparatus, an image forming apparatus, a method for controlling a pressing apparatus, and a computer-readable storage medium.

BACKGROUND ART

An electrophotographic image forming apparatus forms an electrostatic latent image on a photoconductor by optical writing and develops the electrostatic latent image to obtain a toner image. The toner image is transferred to a sheet and is fixed to the sheet through heat, pressure, or the like, thereby forming an image on the sheet.

In full-color image forming apparatuses, a technique is known that transfers a toner image to an intermediate transfer body and transfers the transferred toner image from the intermediate transfer body to a sheet. A color toner image is, for example, once transferred (primarily transferred) to the intermediated transfer body such as an intermediate transfer belt and an intermediate transfer drum. After color toner images of a plurality of colors are superimposed on the intermediate transfer body, the color toner images are transferred (secondarily transferred) from the intermediate transfer body to the sheet. Subsequently, the color toner images on the sheet are fixed, thus achieving a full-color image.

In the image forming apparatus using such an intermediate transfer body, speed fluctuations occurring in the intermediate transfer body cause misregistration of the color toner images during the primary transfer. The misregistration of the color toner images can cause color irregularities or streaky images, thus reducing image quality.

In order to suppress the speed fluctuations of the intermediate transfer body, rotary eccentricity has been conventionally suppressed by increasing the accuracy of machining shafts and motors or by using high-precision gears. In control systems, two sensors are used to suppress mounting eccentricity of a rotary encoder of a rotary detection system, or a gain of a control circuit is increased to increase detection sensitivity, thereby suppressing rotary fluctuations. These measures can effectively suppress the speed fluctuations of the intermediate transfer body caused by periodic stationary disturbances.

The speed fluctuations of the intermediate transfer body can also occur by a sheet rushing into a nip in between the intermediate transfer body and a roller in which the secondary transfer is performed. When the sheet enters the nip, for example, a load of the roller increases or decreases, and a transfer speed of the intermediate transfer body momentarily slows or decreases. In other words, the speed fluctuations of the intermediate transfer body occur.

The sheet rushing is a non-stationary, transient disturbance and has broad frequency characteristics. The above-described measures have difficulty in effectively suppressing the speed fluctuations of the intermediate transfer body caused by such a non-stationary disturbance.

The disturbance caused by the sheet rushing may not only cause the speed fluctuations of the intermediate transfer body but also vibrate an optical writing unit or a primary transfer unit through a casing. Such vibration causes a reduction in image quality.

In Japanese Laid-open Patent Publication No. 2008-139749, in order to suppress load fluctuations and speed fluctuations of an intermediate transfer belt caused by sheet passing, load facing rollers that nip the intermediate transfer belt are provided. By giving a rotational load to the load facing rollers in advance, an influence of the load fluctuations is reduced not only at the time of sheet passing. The load facing rollers are given a rotational load by a sliding abutment member and are brought into pressing against the intermediate transfer belt by springs.

In Japanese Patent No. 4807752, a pressurizing roller and a heat roller nip a recording medium therebetween, and an actuator controls a pressurizing force of a spring applied to the pressurizing roller. The actuator adjusts the distance between a holding member that holds the pressurizing roller and the spring and the heat roller, thereby changing the pressurizing force of the spring.

In Japanese Laid-open Patent Publication No. 2008-139749, although positions of the rollers are controlled by a cam, a pressing force of the rollers by the springs is not controlled. Given this configuration, owing to fluctuations of the shape and thickness of sheets, for example, force can abruptly acts on the intermediate transfer belt.

In Japanese Patent No. 4807752, although the actuator controls a position of the holding member, the actuator does not directly control a pressurizing force of the heat roller. Given this configuration, adjustment of the pressurizing force of the heat roller is restricted to be within a movable range of the spring. Furthermore, it is difficult to increase responsiveness about controlling the pressurizing force of the heat roller.

Therefore, there is a need to set force acting on a part that can come close to or separate from an object with high precision and good responsiveness.

SUMMARY OF THE INVENTION

It is an object of the present invention to at least partially solve the problems in the conventional technology.

According to an embodiment, there is provided a pressing apparatus that includes a presser including a second member configured to come close to or separate from a first member; an elastic member configured to apply force in a direction in which the second member comes close to the first member to the presser, the elastic member being mounted on the presser; an actuator configured to apply force in a direction in which the second member comes close to the first member or separates from the first member to the presser, the actuator being mounted on the presser; an acquirer configured to acquire a parameter containing at least one of a position of the presser, a speed of the presser, and force applied by the actuator to the presser; and a controller configured to feedback-control the actuator based on the parameter.

According to another embodiment, there is provided an image forming apparatus that includes a first member including an intermediate transfer body on which an image is formed; and the pressing apparatus according to the above embodiment. The second member is pressed against a sheet arranged in between the second member and the first member and transfers the image formed on the first member to the sheet.

According to still another embodiment, there is provided a method for controlling a pressing apparatus that includes a presser including a second member configured to come close to or separate from a first member, an elastic member configured to apply force in a direction in which the second member comes close to the first member to the presser, the elastic member being mounted on the presser, and an actuator configured to apply force in a direction in which the second member comes close to the first member or separates from the first member to the presser, the actuator being mounted on the presser. The method includes: acquiring a parameter containing at least one of a position of the presser, a speed of the presser, and force applied by the actuator to the presser; and feedback-controlling the actuator based on the parameter.

According to yet still another embodiment, there is provided a computer-readable storage medium with an executable program stored thereon and executed in a computer of a pressing apparatus that includes a presser including a second member configured to come close to or separate from a first member, an elastic member configured to apply force in a direction in which the second member comes close to the first member to the presser, the elastic member being mounted on the presser, and an actuator configured to apply force in a direction in which the second member comes close to the first member or separates from the first member to the presser, the actuator being mounted on the presser. The program instructs the computer to perform: acquiring a parameter containing at least one of a position of the presser, a speed of the presser, and force applied by the actuator to the presser; and feedback-controlling the actuator based on the parameter.

The above and other objects, features, advantages and technical and industrial significance of this invention will be better understood by reading the following detailed description of presently preferred embodiments of the invention, when considered in connection with the accompanying drawings.

DESCRIPTION OF EMBODIMENTS

The following describes embodiments of an image forming apparatus and a method for controlling a pressing apparatus in detail with reference to the accompanying drawings. A plurality of expressions may be described together for any component according to the embodiments and a description of the component. For the component and the description thereof, other expressions that are not described herein will not be prevented from being used. Furthermore, for any component and a description thereof for which a plurality of expressions are not described, other expressions will not be prevented from being used.

The following describes examples in which the pressing apparatus according to the embodiments is used for a copying machine forming color images as an example of the image forming apparatus. The pressing apparatus, however, can be used for other apparatuses; it can be used, for example, for printing apparatuses that receive image data from external controllers such as personal computers (PCs) and form images. The pressing apparatus can also be used for, for example, copying machines, printers, scanner apparatuses, facsimile apparatuses, and image forming apparatuses such as multifunction printers having at least two pieces of functionality among copying functionality, printer functionality, scanner functionality, and facsimile functionality.

The pressing apparatus according to the embodiments can also be used for other kinds of apparatuses if it includes a structure that presses a member against an object by an elastic member and an actuator. The pressing apparatus can also be used for, for example, photoconductors, sheet conveying rollers, thermal fixing rollers, and sheet conveying rollers of inkjet printers and copying machines.

Figure 1:
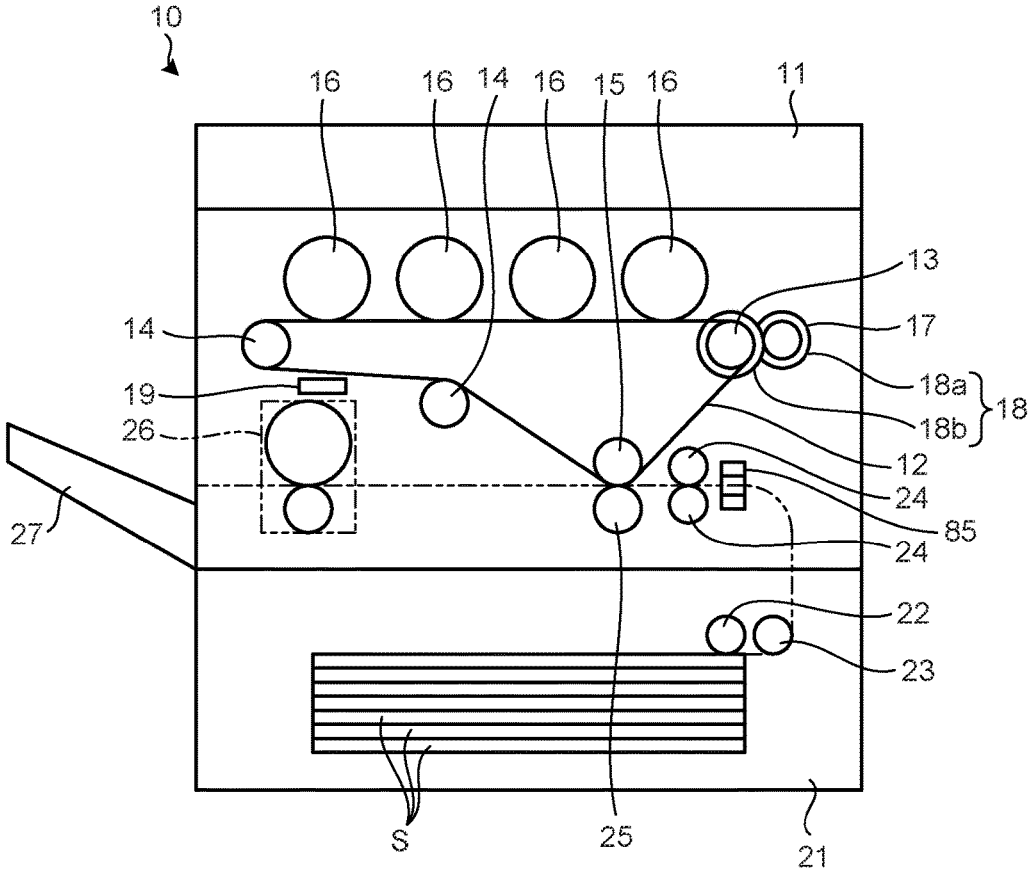
FIG. 1 is a diagram schematically illustrating an exemplary configuration of an image forming apparatus according to a first embodiment.

FIG. 1 is a diagram schematically illustrating an exemplary configuration of a tandem color electrophotographic image forming apparatus 10 according to a first embodiment. As illustrated in FIG. 1, the image forming apparatus 10 includes a scanner unit 11, an intermediate transfer belt 12, a drive roller 13, two driven rollers 14, a repulsive force roller 15, four photoconductor units 16, a motor 17, a reduction mechanism 18, a belt encoder sensor 19, a sheet feeding unit 21, a sheet feeding roller 22, a paper conveying roller 23, two registration rollers 24, a secondary transfer roller 25, a fixing unit 26, and a paper ejecting unit 27. The intermediate transfer belt 12 is an example of a first member and an intermediate transfer body. The secondary transfer roller 25 is an example of a second member.

The scanner unit 11 reads an image of a document mounted on a top face of a document base. The intermediate transfer belt 12 is looped over the drive roller 13, the driven rollers 14, and the repulsive force roller 15. A mechanism including the intermediate transfer belt 12, the drive roller 13, the driven rollers 14, and the repulsive force roller 15 is called a belt mechanism 30.

The four photoconductor units 16 correspond to respective four colors including yellow (Y), cyan (C), magenta (M), and black (K). Each of the photoconductor units 16 includes a drum-shaped photoconductor drum as a latent image carrier and various components such as a photoconductor cleaning roller.

The photoconductor units 16 superimpose toner images of the respective YCMK colors on the intermediate transfer belt 12 as an image forming medium to form a full-color image. The photoconductor units 16 are not limited to this example, and three photoconductor units 16 corresponding to respective YCM colors may be provided to the image forming apparatus 10, for example.

The drive roller 13 drives the intermediate transfer belt 12. The motor 17 drives the drive roller 13 through the reduction mechanism 18. The reduction mechanism 18 includes gears 18*a*, 18*b* having different numbers of teeth. The gears 18*a*, 18*b* mesh with each other, reduce the rotational speed of the motor 17, and transmit the rotation to the drive roller 13.

The belt encoder sensor 19 is an encoder for measuring a surface speed of the intermediate transfer belt 12. The belt encoder sensor 19 detects a scale formed on the intermediate transfer belt 12 and generates pulse output.

The sheet feeding unit 21 houses a plurality of transfer sheets S in a stacked manner. The transfer sheet S is an example of a sheet. The sheet feeding roller 22 sends out the transfer sheet S from the sheet feeding unit 21 to a conveying path illustrated with a chain doubled-dashed line in FIG. 1. The paper conveying roller 23 is arranged on the conveying path to convey the transfer sheet S sent out from the sheet feeding roller 22 to the registration rollers 24. The registration rollers 24 perform skew correction on the transfer sheet S, the conveyance of the transfer sheet S, and the like.

The secondary transfer roller 25 is arranged so as to face the repulsive force roller 15. The repulsive force roller 15 forms a nip in between the intermediate transfer belt 12 and the secondary transfer roller 25 and maintains the nip. The secondary transfer roller 25 transfers the toner images of the respective YCMK colors formed on the intermediate transfer belt 12 by the photoconductor units 16 to the transfer sheet S passing through the nip.

The secondary transfer roller 25 can freely rotate and rotates through contact with the intermediate transfer belt 12 or the transfer sheet S conveyed. The image forming apparatus 10 may include a mechanism for rotatingly driving the secondary transfer roller 25.

The fixing unit 26 fixes the toner images transferred by the secondary transfer roller 25 onto the transfer sheet S through heating and pressurizing. The transfer sheet S with the toner images transferred and fixed is discharged to the paper ejecting unit 27.

In the above-described configuration, speed fluctuations occurring in the surface speed of the intermediate transfer belt 12 can cause misregistration of the toner images of the respective YCMK colors or the expansion and contraction of the toner images. These phenomena can cause image defects such as color shifts or gradation called banding.

Examples of causes that change the surface speed of the intermediate transfer belt 12 include frictional load, eccentricity and load fluctuations of rotating bodies such as the drive roller 13 and the gears 18*a*, 18*b*, fluctuations of the thickness of the intermediate transfer belt 12, mounting eccentricity of rotary-encoders that detect rotational positions of the rotating bodies, mounting eccentricity and load fluctuations of the reduction mechanism 18, rotation irregularities of the motor 17, the rush of the transfer sheet S into the nip, and torque fluctuations by turning on and off of a clutch.

The multiple causes of the speed fluctuations of the intermediate transfer belt 12 can be considered as disturbances. The speed fluctuations of the intermediate transfer belt 12 by the frictional load are stationary or extremely low frequency components. For this reason, the speed fluctuations can be suppressed by feedback control. The speed fluctuations by the fluctuations of the thickness of the intermediate transfer belt 12 are also lower frequency components than the speed fluctuations by the eccentricity of the other rotating bodies or the like. For this reason, the speed fluctuations can be suppressed by feedback control based on the surface speed of the intermediate transfer belt 12.

Among fluctuation components of the rotating bodies, the eccentricity of the reduction mechanism 18 and the rotation irregularities of the motor 17 have frequencies close to a mechanical resonance frequency (hereinafter, called a mechanical resonance frequency of the belt mechanism 30) caused by rigidity of the rotating bodies and the intermediate transfer belt 12 or rigidity of a connecting part between the drive roller 13 and the reduction mechanism 18. Given this situation, a control system that simply feeds back the surface speed of the intermediate transfer belt 12 is a control system having a response frequency that is the mechanical resonance frequency of the belt mechanism 30 or less. Consequently, the disturbances are not sufficiently suppressed due to gain shortage, making it difficult to achieve desired required specifications.

Given these circumstances, a double-loop feedback control system is developed that includes a minor loop that feeds back a rotational speed of a drive shaft after speed reduction and a major loop that feeds back a surface speed of a belt. The rotational speed of the drive shaft is, for example, obtained from a rotary encoder mounted on the drive shaft. The surface speed of the belt is, for example, obtained from an encoder pattern on a belt surface.

Japanese Patent Application Laid-open No. 2009-222112 discloses a belt drive controller that, in the double-loop feedback control system, further includes a unit that amplifies a gain of a desired frequency in the minor loop. This structure can suppress frequency components caused by eccentricity of a reduction mechanism or rotation irregularities of a motor.

Figure 2:
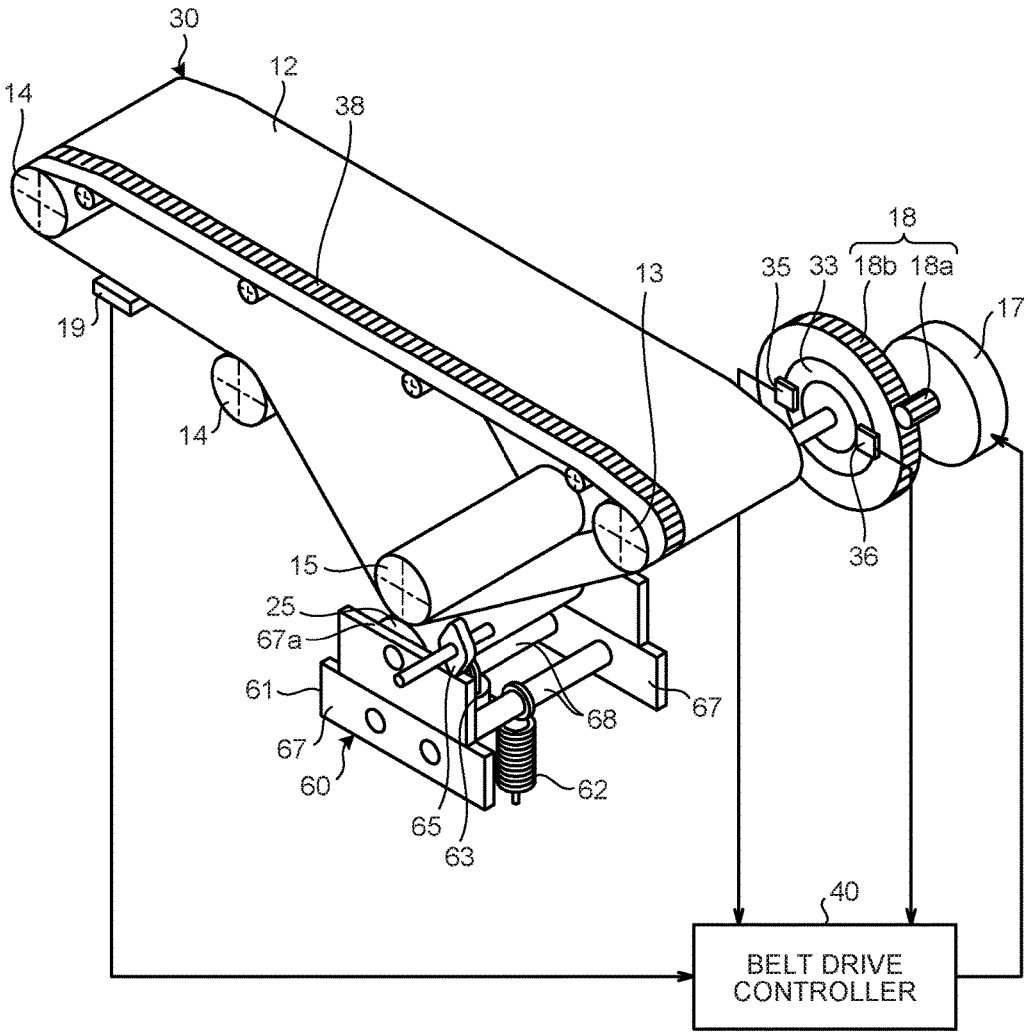
FIG. 2 is a perspective view illustrating a part of the image forming apparatus including a belt mechanism of the first embodiment.
Figure 3:
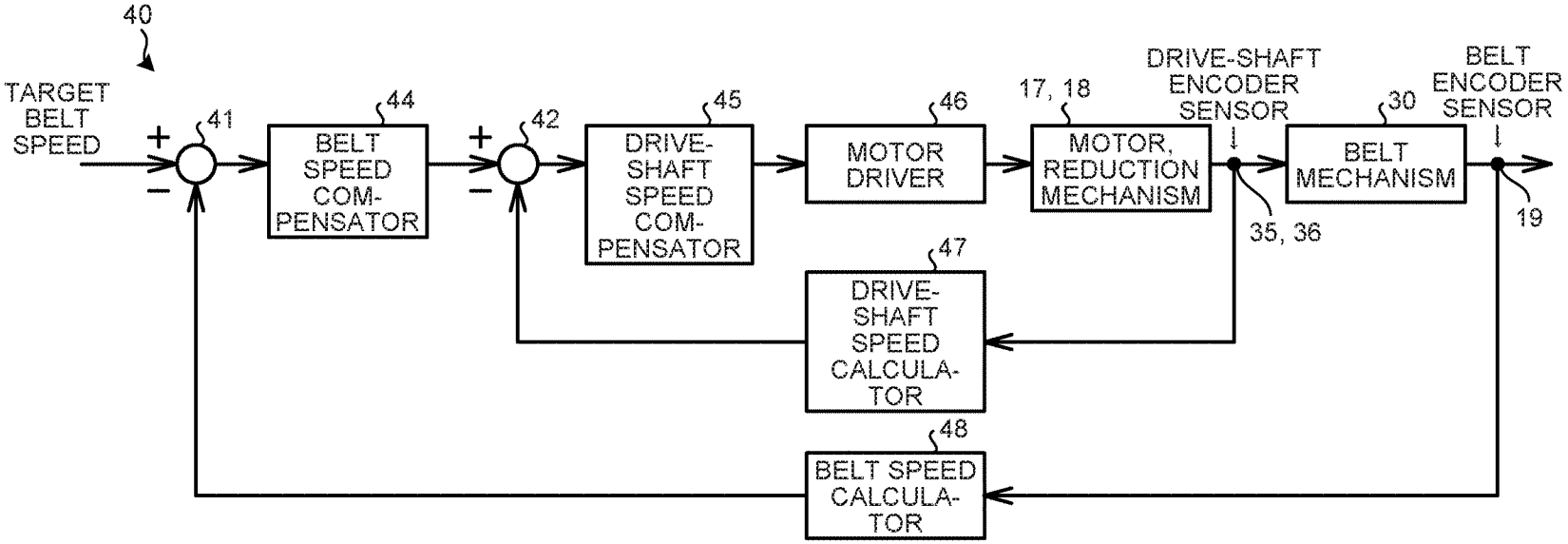
FIG. 3 is a block diagram illustrating an exemplary configuration of a belt drive controller of the first embodiment.

The following describes the image forming apparatus 10 in more detail with reference to FIG. 2 and FIG. 3. FIG. 2 is a perspective view schematically illustrating a part of the image forming apparatus 10 including the belt mechanism 30 of the first embodiment.

The gear 18*a* of the reduction mechanism 18 is formed on a shaft of the motor 17. The gear 18*b* of the reduction mechanism 18 is a reduction gear that reduces the rotational speed of the gear 18*a* and transmits the rotation to the drive roller 13. In the example of FIG. 2, the gears 18*a*, 18*b* constitute the reduction mechanism 18.

In the reduction mechanism 18, an input side gear (gear 18*a*) may be mounted on the shaft of the motor 17. Although the reduction mechanism 18 includes the two gears 18*a*, 18*b* in the example of FIG. 2, the reduction mechanism 18 is not limited to this example. The reduction mechanism 18 may include, for example, three or more gears or may be a planetary gear mechanism.

A code wheel 33 of a rotary encoder is mounted on an output shaft (the gear 18*b* in the example of FIG. 2) of the reduction mechanism 18. Two drive-shaft encoder sensors 35, 36 are arranged facing the code wheel 33.

The drive-shaft encoder sensors 35, 36 read a slit of the code wheel 33. The drive-shaft encoder sensors 35, 36 are arranged at positions out of phase by 180 degrees relative to the code wheel 33. By using an average of outputs of the drive-shaft encoder sensors 35, 36, an eccentric component of the code wheel 33 is corrected.

The drive-shaft encoder sensors 35, 36 detect motion of the code wheel 33 and output an encoder pulse as a binary signal. The outputs of the drive-shaft encoder sensors 35, 36 may be two-phase binary signals out of phase by 90 degrees, single-phase analog signals, or two-phase analog signals.

The following describes an example using the two drive-shaft encoder sensors 35, 36. However, the eccentric component of the code wheel 33 can be suppressed by feedback of the surface speed of the intermediate transfer belt 12. In this case, only either one of the drive-shaft encoder sensors 35, 36 may be used.

In the belt mechanism 30, the drive roller 13 is driven by a rotating shaft of the gear 18*b* as the output shaft of the reduction mechanism 18. The output shaft of the reduction mechanism 18 and a shaft of the drive roller 13 may be integrally formed or coupled through, for example, a joint mechanism for the sake of maintainability.

The intermediate transfer belt 12 is supported by the drive roller 13, the driven rollers 14, and the repulsive force roller 15. The drive roller 13 drives the intermediate transfer belt 12. The driven rollers 14 have a tension adjusting mechanism for the intermediate transfer belt 12. The repulsive force roller 15 has functionality of a transfer shaft that transfers the toner images formed on the intermediate transfer belt 12 to the transfer sheet S.

An encoder pattern 38 is provided on the surface of the intermediate transfer belt 12. The belt encoder sensor 19 reads the encoder pattern 38, thereby detecting the surface speed (belt surface speed) of the intermediate transfer belt 12. In other words, the belt encoder sensor 19 outputs an encoder pulse as a binary output in accordance with the read encoder pattern 38.

The encoder pattern 38 may be provided on the back of the intermediate transfer belt 12. In the example of FIG. 2, the belt encoder sensor 19 is provided in between the two driven rollers 14. However, this is an example, and the belt encoder sensor 19 may be provided at another position at which the intermediate transfer belt 12 is flat in order to accurately measure the belt surface speed. The belt encoder sensor 19 may be, for example, arranged in between the drive roller 13 and one of the driven rollers 14 or in between the drive roller 13 and the repulsive force roller 15.

When the belt encoder sensor 19 is arranged on any of the rotating shafts of the respective rollers, for example, an influence of the curvature of the rotating shaft appears in output of the belt encoder sensor 19. In this case, intervals of the encoder pattern 38 can change by fluctuations of the thickness of the intermediate transfer belt 12 in manufacturing and owing to environmental changes, and the belt surface speed detected by the belt encoder sensor 19 can be inaccurate. For this reason, the belt encoder sensor 19 is arranged avoiding positions on the rotating shafts of the respective rollers.

The encoder pattern 38 can be provided by various methods. The encoder pattern 38 having a sheet shape, for example, may be affixed to the intermediate transfer belt 12. The encoder pattern 38 may be directly worked on the intermediate transfer belt 12. The encoder pattern 38 may be formed integrally with the intermediate transfer belt 12 during a process of manufacturing the intermediate transfer belt 12.

The belt encoder sensor 19 is, for example, a reflection-type optical sensor having equally spaced slits. However, the belt encoder sensor 19 may be any sensor that can accurately detect a surface position of the intermediate transfer belt 12 from the encoder pattern 38.

The belt encoder sensor 19 may image the encoder pattern 38 using, for example, a camera with a charge coupled device (CCD) used as an imaging element and perform image processing on an image taken, thereby detecting the surface position. Furthermore, the belt encoder sensor 19 may be of the Doppler type or of the sensor type that can detect the surface position from irregularities on a belt surface through image processing. In this case, the encoder pattern 38 may be omitted.

The image forming apparatus 10 further includes a belt drive controller 40. The outputs of the drive-shaft encoder sensors 35, 36 and the output of the belt encoder sensor 19 are input to the belt drive controller 40.

The belt drive controller 40 computes a rotational speed of the drive roller 13 and the belt surface speed using the output signals of the drive-shaft encoder sensors 35, 36 and the belt encoder sensor 19. The belt drive controller 40 performs certain control computation based on the computation result and determines a command value for driving the motor 17 at a certain rotational speed. The command value is delivered to a motor driver 46 (illustrated in FIG. 3), and the motor driver 46 drives the motor 17 in accordance with the command value.

The motor 17 may be a brush-equipped motor or a brushless motor. A drive circuit of the motor driver 46 is determined in accordance with the type of the motor 17. The motor driver 46 may be of the voltage control type or of the current control type. The motor driver 46 of the current control type is robust against changes with time passage and environmental changes. Examples of a signal type of the command value for the motor driver 46 include, but not limited to, analog value, digital value, and pulse width modulation (PWM). The motor driver 46 may be any one that can obtain output proportional to the command value. The motor driver 46 may be PWM driven or linearly driven.

The control computation performed by the belt drive controller 40 may be performed using either analog value or digital value. Control computation is generally performed using, for example, digital computing devices such as a central processing unit (CPU) and a digital signal processor (DSP), and in this case, the control computation is described with software. This description is not limiting, and for simple control computation or operation logic with no parameter change, the control computation may be performed by hardware logic.

FIG. 3 is a block diagram illustrating an exemplary configuration of the belt drive controller 40 of the first embodiment. FIG. 3 also illustrates the motor 17, the reduction mechanism 18, the belt encoder sensor 19, the belt mechanism 30, and the drive-shaft encoder sensors 35, 36 for illustration.

As illustrated in FIG. 3, the belt drive controller 40 includes comparators 41, 42, a belt speed compensator 44, a drive-shaft speed compensator 45, the motor driver 46, a drive-shaft speed calculator 47, and a belt speed calculator 48.

In the belt drive controller 40, the motor driver 46 drives the motor 17 in accordance with a command value output from the drive-shaft speed compensator 45 and drives a mechanism unit including the motor 17, the reduction mechanism 18, and the belt mechanism 30. FIG. 3 illustrates the motor 17 and the reduction mechanism 18 collectively and the two drive-shaft encoder sensors 35, 36 collectively.

The belt drive controller 40 controls a rotational speed of the motor 17 by a double loop including a major loop and a minor loop. The major loop feeds back the belt surface speed based on the output of the belt encoder sensor 19 of the belt mechanism 30. The minor loop, based on the outputs of the drive-shaft encoder sensors 35, 36 mounted on the drive shaft of the gear 18*b*, feeds back the rotational speed of the drive shaft.

A target speed of the intermediate transfer belt 12 (a target belt speed) set in advance is input to one input end of the comparator 41. The belt speed calculator 48 calculates a speed of the intermediate transfer belt 12 (a belt speed) based on the output of the belt encoder sensor 19 provided to the belt mechanism 30. The calculated belt speed is input to the other end of the comparator 41.

The comparator 41 compares the values input to the one and the other input ends and outputs a difference. More specifically, the comparator 41 subtracts the belt speed input to the other input end from the target belt speed input to the one input end and outputs a belt speed deviation. The belt speed deviation is input to the belt speed compensator 44.

The belt speed compensator 44 outputs a target drive-shaft speed based on the belt speed deviation. The target drive-shaft speed is a target speed for driving the drive roller 13 so as to control the belt surface speed of the intermediate transfer belt 12 to be constant. The target drive-shaft speed is input to one input end of the comparator 42.

The drive-shaft speed calculator 47 calculates a rotational speed of the drive shaft of the gear 18*b* (a drive-shaft speed) based on the outputs of the drive-shaft encoder sensors 35, 36. The calculated drive-shaft speed is input to the other input end of the comparator 42.

The comparator 42 compares the values input to the one and the other input ends and outputs a difference. More specifically, the comparator 42 subtracts the drive-shaft speed input to a subtraction input end from the target drive-shaft speed input to a subtracted input end and outputs a drive-shaft speed deviation.

The drive-shaft speed compensator 45 calculates a motor command value (a command value) designating the rotational speed of the motor 17 based on the drive-shaft speed deviation. The motor command value is input to the motor driver 46. The motor driver 46 drives the motor 17 in accordance with the corrected motor command value input from the drive-shaft speed compensator 45.

The motor driver 46, for example, passes a voltage or current proportional to the corrected command value to the motor 17. The rotation of the motor 17 is transmitted to the drive roller 13 through the gears 18*a*, 18*b* to drive the belt mechanism 30 including the intermediate transfer belt 12.

The rotational speed of the drive shaft of the gear 18*b* is detected by the rotary encoder (the drive-shaft encoder sensors 35, 36), whereas the belt surface speed is detected by a linear encoder (the belt encoder sensor 19). Given this situation, the rotational speed of the drive shaft and the belt surface speed have different unit systems.

Detection output of a rotary encoder is generally output in terms of angle and is represented with a unit system of radian (rad). Detection output of a linear encoder is output in terms of length and is represented with a unit system of meter (m). The speeds determined by the drive-shaft encoder sensors 35, 36 and the belt encoder sensor 19 are converted into either one of the unit systems.

When the rotational speed of the drive shaft is adapted to the belt surface speed, the unit of the speed is meters per second (m/s). The drive-shaft speed calculator 47 contains a coefficient for converting the unit system of the drive-shaft speed into "m/s". The drive-shaft speed compensator 45 also has a coefficient for adapting to "m/s".

When the belt surface speed is adapted to the drive-shaft speed, the unit of the speed is radian per second (rad/s). The belt speed compensator 44 has a coefficient for converting the unit system of the target drive-shaft speed into "rad/s".

A response frequency of the minor loop, which is on the inside and feeds back the value of the rotary encoder (the drive-shaft encoder sensors 35, 36), is sufficiently higher than a response frequency of the major loop, which is on the outside and feeds back the value of the linear encoder (belt encoder sensor 19). In general, a band of the response frequency of the minor loop is a frequency band 5 to 10 times higher than a band of the response frequency of the major loop.

Figure 4:
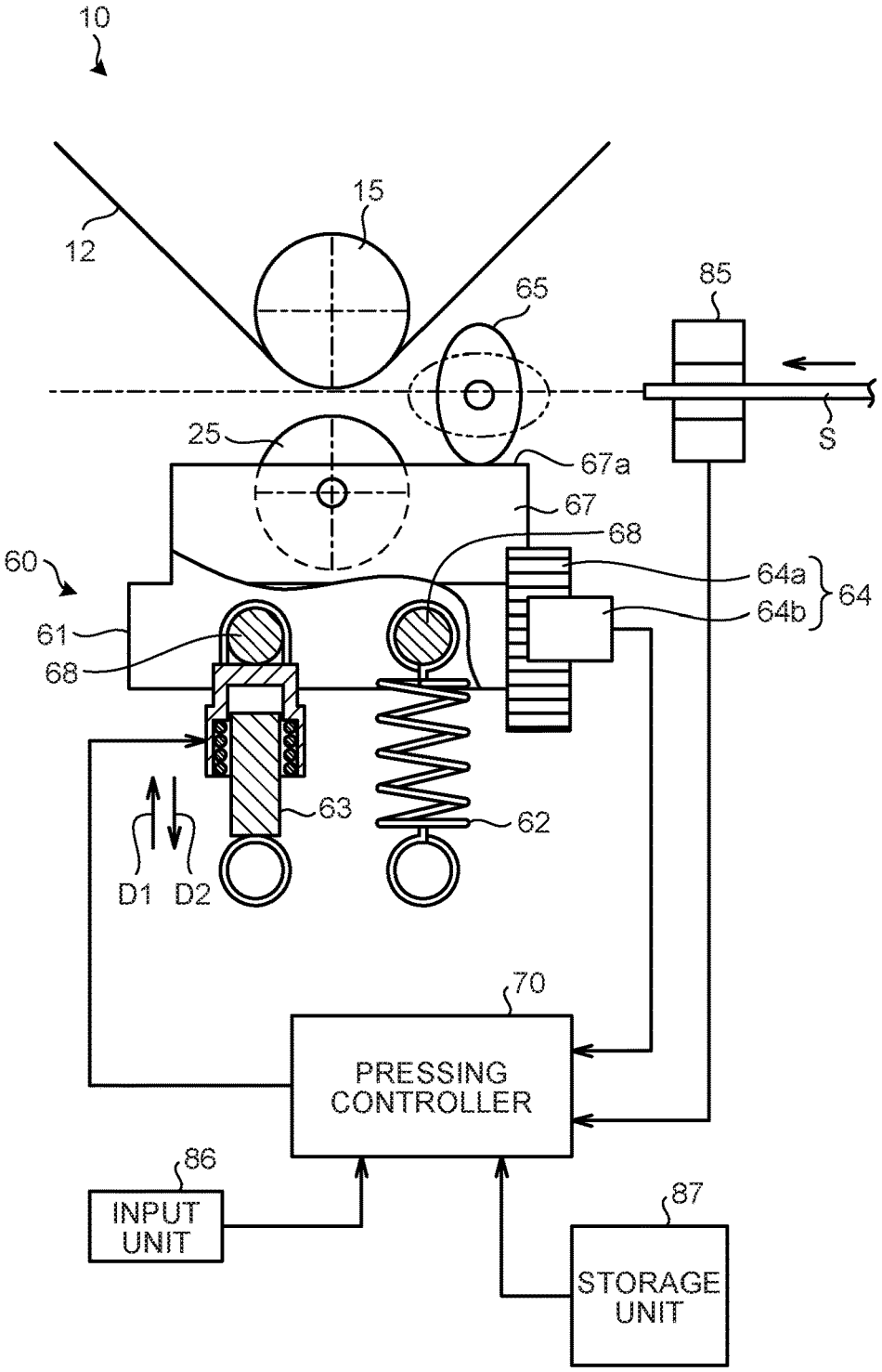
FIG. 4 is a side view illustrating a part of the image forming apparatus including a pressing apparatus of the first embodiment.

FIG. 4 is a side view partially cutting out and schematically illustrating a part of the image forming apparatus 10 including a pressing apparatus 60 of the first embodiment. As illustrated in FIG. 4, the image forming apparatus 10 further includes the pressing apparatus 60.

The pressing apparatus 60 includes a pressing unit 61, a spring 62, an actuator (motor) 63, an encoder 64, and a cam 65. The spring 62 is an example of the elastic member. The encoder 64 is an example of an acquisition unit.

As illustrated in FIG. 2, the pressing unit 61 includes the secondary transfer roller 25, two supporting members 67, and two beams 68. The pressing unit 61 can move in a direction (an up-and-down direction, for example) in which the secondary transfer roller 25 comes close to or separates from the intermediate transfer belt 12 looped over the repulsive force roller 15. The pressing unit 61 may be restricted in its moving direction to be, for example, the up-and-down direction by, for example, a rail.

The two supporting members 67 are arranged so as to face each other. The secondary transfer roller 25 is arranged in between the two supporting members 67. The two supporting members 67 rotatably support the secondary transfer roller 25. The two beams 68 are, for example, formed into a cylindrical shape and extend from one supporting member 67 to the other supporting member 67. The configuration of the pressing unit 61 is not limited to this example.

As illustrated in FIG. 4, the spring 62 is, for example, a compression spring. One end of the spring 62 is mounted on one beam 68 of the pressing unit 61. The other end of the spring 62 is fixed to, for example, a casing of the image forming apparatus 10.

The spring 62 applies force in a direction (the upper direction in FIG. 4) in which the secondary transfer roller 25 of the pressing unit 61 comes close to the repulsive force roller 15 over which the intermediate transfer belt 12 is looped to the pressing unit 61. In other words, the spring 62 pushes the secondary transfer roller 25 toward the repulsive force roller 15 and the intermediate transfer belt 12 looped over the repulsive force roller 15. The force applied by the spring 62 to the pressing unit 61 is proportional to an amount of expansion and contraction of the spring 62.

The spring 62 supports the pressing unit 61 and performs gravity compensation of the pressing unit 61. Furthermore, the spring 62 pushes the secondary transfer roller 25 toward the repulsive force roller 15 and the intermediate transfer belt 12, thereby generating a transfer pressure between the secondary transfer roller 25 and the intermediate transfer belt 12.

The actuator 63 is, for example, a translation actuator having a voice coil motor. The actuator 63 is not limited to this example and may be another actuator that can control force such as a three-phase linear motor.

One end of the actuator 63 is mounted on the other beam 68 of the pressing unit 61. The spring 62 and the actuator 63 may be mounted on the same beam 68. The other end of the actuator 63 is, for example, fixed to the casing of the image forming apparatus 10. Thus, the spring 62 and the actuator 63 are mounted on the pressing unit 61 in parallel.

The actuator 63 applies force in a first direction D1 or a second direction D2 to the pressing unit 61 in accordance with a current flowing therethrough. The magnitude of the force applied by the actuator 63 to the pressing unit 61 is proportional to the current flowing through the actuator 63.

The first direction D1 is a direction (the upper direction in FIG. 4) in which the secondary transfer roller 25 of the pressing unit 61 comes close to the repulsive force roller 15 over which the intermediate transfer belt 12 is looped. In other words, the actuator 63 pushes the secondary transfer roller 25 toward the repulsive force roller 15 and the intermediate transfer belt 12 looped over the repulsive force roller 15.

The second direction D2 is a direction (the lower direction in FIG. 4) in which the secondary transfer roller 25 separates from the repulsive force roller 15 over which the intermediate transfer belt 12 is looped. In other words, the actuator 63 pulls the secondary transfer roller 25 in a direction departing from the repulsive force roller 15 and the intermediate transfer belt 12 looped over the repulsive force roller 15.

The actuator 63 applies the force in the first direction D1 or the second direction D2 to the pressing unit 61, thereby adjusting the transfer pressure between the secondary transfer roller 25 and the intermediate transfer belt 12. Furthermore, the actuator 63 applies the force to the pressing unit 61, thereby suppressing vibration of the pressing unit 61 or moving the pressing unit 61. Detailed operation of the actuator 63 will be described later.

The encoder 64 is, for example, a linear encoder. The encoder 64 may be another device such as an eddy-current displacement meter, a capacitance displacement meter, a noncontact sensor using focus, and a variable-resistance contact sensor.

The encoder 64 includes, for example, a pattern 64*a* and a sensor 64*b*. The pattern 64*a* is provided to the pressing unit 61 and can move together with the pressing unit 61. The sensor 64*b* is arranged facing the pattern 64*a*, detects the pattern 64*a*, and outputs an encoder pulse, which is a binary output responsive to the detected pattern 64*b*. The sensor 64*b* reads the pattern 64*a*, thereby detecting a position (displacement) of the pressing unit 61. The position of the pressing unit 61 is an example of a parameter. The encoder 64, for example, detects a displacement amount of the pressing unit 61 in the up-and-down direction.

The cam 65 is, for example, formed into an elliptic shape. The shape of the cam 65 is not limited to this example. The cam 65 is arranged facing an upper end 67*a* of the supporting member 67 of the pressing unit 61. The upper end 67*a* of the supporting member 67 is an end of the supporting member 67 facing the intermediate transfer belt 12 looped over the repulsive force roller 15. The cam 65 may be arranged at another position.

The cam 65 is rotated by a drive unit such as a motor. The cam 65 rotates, thereby causing the secondary transfer roller 25 and the intermediate transfer belt 12 lopped over the repulsive force roller 15 to come close to or separate from each other.

When the image forming apparatus 10 is out of operation, for example, the cam 65 is arranged at a position (the position illustrated in the solid line in FIG. 4) at which the major axis of the cam 65 extends toward the supporting member 67. In this situation, the cam 65 is in contact with the upper end 67*a* of the supporting member 67.

The supporting member 67 is in contact with the cam 65, thereby causing the secondary transfer roller 25 to be separate from the intermediate transfer belt 12 looped over the repulsive force roller 15. In other words, the cam 65 supports the pressing unit 61 pushed by the spring 62 at a position at which the secondary transfer roller 25 is separate from the intermediate transfer belt 12. With this configuration, deformation of the secondary transfer roller 25 and the repulsive force roller 15 through contact pressure is suppressed.

When the image forming apparatus 10 operates, for example, for printing, the cam 65 is rotated, and the distance between a central axis of the cam 65 and the perimeter of the cam facing the supporting member 67 shortens. The spring 62 pushes the pressing unit 61, and the pressing unit 61 moves upward in accordance with the rotation of the cam 65. With this operation, the secondary transfer roller 25 comes close to the intermediate transfer belt 12 looped over the repulsive force roller 15.

When the cam 65 further rotates, the secondary transfer roller 25 is pressed against the intermediate transfer belt 12. The cam 65 further rotates to separate from the upper end 67*a* of the supporting member 67. In other words, the cam 65 is detached from the pressing unit 61.

While the image forming apparatus 10 operates, the cam 65 is arranged at a position (the position illustrated in the chain double-dashed line in FIG. 4) at which the minor axis of the cam 65 extends toward the supporting member 67. The cam 65 is detached from the pressing unit 61, and the spring 62 and the actuator 63 push the pressing unit 61 to cause a transfer pressure between the secondary transfer roller 25 and the intermediate transfer belt 12.

The transfer sheet S passing through the nip in between the secondary transfer roller 25 and the intermediate transfer belt 12 is pressed against the intermediate transfer belt 12 by the secondary transfer roller 25. With this operation, the toner images on the intermediate transfer belt 12 are transferred to the transfer sheet S. Furthermore, through the application of bias voltage, the charged toner images are transferred to the transfer sheet S more securely.

When the image forming apparatus 10 shifts to a non-operating status, the cam 65 is rotated again. The rotating cam 65 comes into contact with the upper end 67*a* of the supporting member 67 again. The cam 65 pushes down the pressing unit 61, thereby causing the secondary transfer roller 25 to separate from the intermediate transfer belt 12. The maximum distance between the secondary transfer roller 25 and the intermediate transfer belt 12 separated by the cam 65 is longer than the maximum thickness of the transfer sheet S corresponding to the image forming apparatus 10.

The pressing apparatus 60 further includes a pressing controller 70. The pressing controller 70 is an example of a controller. The pressing controller 70 performs feedback control of the actuator 63 based on the position (displacement) of the pressing unit 61, a speed of the pressing unit 61, and the current flowing through the actuator 63. With this configuration, the vibration of the pressing unit 61 is suppressed, and the transfer pressure of the secondary transfer roller 25 and the position of the pressing unit 61 are dynamically controlled.

The pressing controller 70, for example, performs the feedback control (position control) of the actuator 63 based on the position of the pressing unit 61, thereby positioning the pressing unit 61. The position control adjusts the distance (an amount of separation) between the secondary transfer roller 25 and the intermediate transfer belt 12.

The pressing controller 70 performs the feedback control (speed control) of the actuator 63 based on the speed of the pressing unit 61, thereby moving the pressing unit 61 so as to smoothly follow a target value. Furthermore, the speed control improves damping performance of characteristic vibration (mechanical resonance) occurring in the pressing unit 61 supported by the spring 62 and accelerates convergence of the vibration.

The pressing controller 70 performs the feedback control (current control) of the actuator 63 based on the current flowing through the actuator 63, thereby controlling the force of the actuator 63 proportional to the current to be a desired value. The force applied by the actuator 63 to the pressing unit 61 is controlled, thereby adjusting the force with which the secondary transfer roller 25 pushes the intermediate transfer belt 12 to be a desired value.

Figure 5:
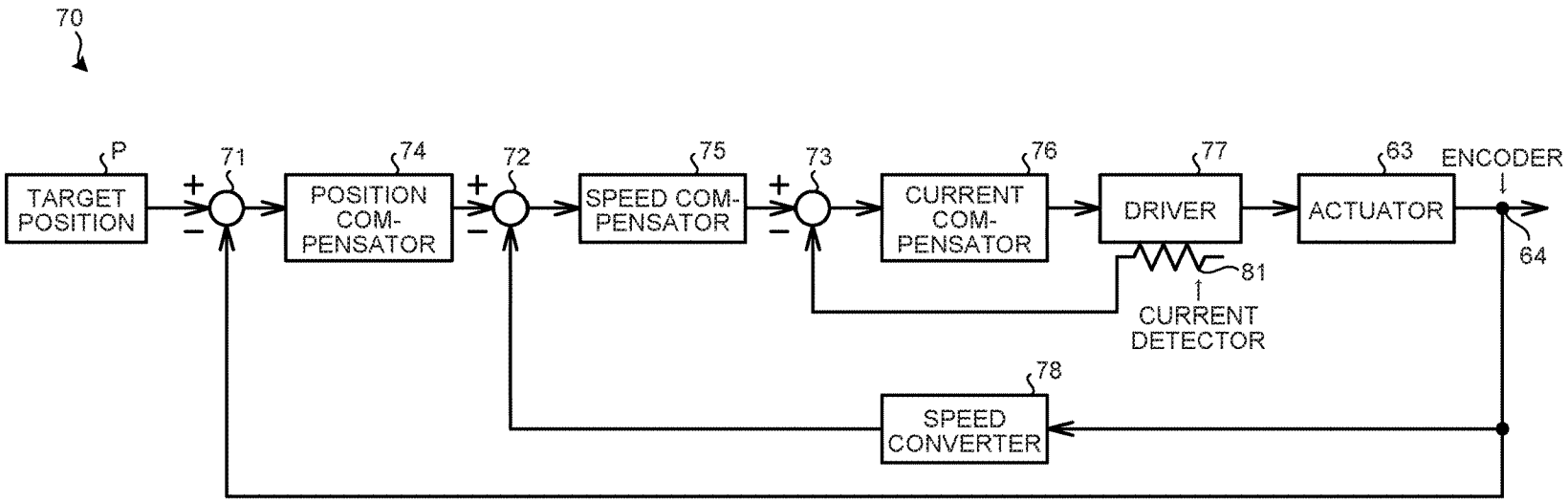
FIG. 5 is a block diagram illustrating an exemplary configuration of a pressing controller of the first embodiment.

FIG. 5 is a block diagram illustrating an exemplary configuration of the pressing controller 70 of the first embodiment. As illustrated in FIG. 5, the pressing controller 70 includes comparators 71, 72, 73, a position compensator 74, a speed compensator 75, a current compensator 76, a driver 77, and a speed converter 78. The speed converter 78 is an example of the acquisition unit. FIG. 5 also illustrates the actuator 63 and the encoder 64 for illustration.

In the pressing controller 70, the driver 77 applies a voltage to the actuator 63 in accordance with a voltage command value output from the current compensator 76. In other words, the driver 77 drives the actuator 63.

A current detector 81 is provided to the driver 77. The current detector 81 is an example of the acquisition unit. The current detector 81 detects the current flowing through the actuator 63. The current detector 81 may be provided to the actuator 63. The current detector 81 is, for example, a current sensor using a resistance for detection or a Hall element.

The force applied by the actuator 63 to the pressing unit 61 is proportional to the current flowing through the actuator 63 as described above. In other words, the pressing controller 70 acquires the force applied by the actuator 63 to the pressing unit 61 by the current detector 81. The force applied by the actuator 63 to the pressing unit 61 is an example of the parameter.

The pressing controller 70 is a multi-loop control system including feedback loops of current control, speed control, and position control. The feedback loop of the current control feeds back the current flowing through the actuator 63 to control the actuator 63. The feedback loop of the speed control feeds back the speed of the pressing unit 61 based on the output of the encoder 64 to control the actuator 63. The feedback loop of the position control feeds back the position of the pressing unit 61 based on the output of the encoder 64 to control the actuator 63.

The feedback of the current control generally requires a high frequency band and may be computed by a calculator different from those for computing the speed control and the position control, and control computation may be analog computation or digital computation. The driver, the current detector, and the feedback of the current control are cut out to form a unit called a current amplifier, which may be used.

A target position P of the pressing unit 61 is input to one input end of the comparator 71. The target position P of the pressing unit 61 will be described later. Furthermore, the output of the encoder 64 as the position (displacement) of the pressing unit 61 is input to the other input end of the comparator 71.

The comparator 71 compares the values input to the one and the other input ends and outputs a difference. More specifically, the comparator 71 subtracts the displacement input to the other input end from the target position P input to the one input end and outputs a position deviation. The position deviation is input to the position compensator 74.

The position compensator 74 outputs a speed command value based on the position deviation. The speed command value is a target speed for driving the actuator 63 so as to control the pressing unit 61 to be the target position P. The speed command value is input to the one input end of the comparator 72.

The speed converter 78 calculates the speed of the pressing unit 61 based on the output of the encoder 64. In other words, the speed converter 78 acquires the speed of the pressing unit 61 from the output of the encoder 64. The speed of the pressing unit 61 is an example of the parameter.

The speed converter 78, for example, measures a difference of the encoder 64 or a cycle of the encoder pulse with a reference clock and takes its inverse, thereby calculating the speed of the pressing unit 61. The speed converter 78 may calculate the speed of the pressing unit 61 by another method. The calculated speed of the pressing unit 61 is input to the other input end of the comparator 72.

The comparator 72 compares the values input to the one and the other input ends and outputs a difference. More specifically, the comparator 72 subtracts the speed of the pressing unit 61 input to a subtraction input end from the speed command value input to a subtracted input end and outputs a speed deviation. The speed deviation is input to the speed compensator 75.

The speed compensator 75 calculates a current command value based on the speed deviation. The current command value is a target current value for driving the actuator 63 so as to control the pressing unit 61 to be the target speed. The current command value is input to the comparator 73. Furthermore, an output of the current detector 81 (the current of the actuator 63) is input to the comparator 73.

The comparator 73 compares the values input to the one and the other input ends and outputs a difference. More specifically, the comparator 73 subtracts the current of the actuator 63 input to the other input end from the current command value input to the one input end and outputs a current deviation. The current deviation is input to the current compensator 76.

The current compensator 76 calculates the voltage command value based on the current deviation. The voltage command value is a voltage command value for driving the actuator 63 so as to control the force applied by the actuator 63 to the pressing unit 61.

The voltage command value is input to the driver 77. The driver 77 drives the actuator 63 in accordance with the voltage command value input from the current compensator 76. The driver 77, for example, applies a voltage corresponding to the voltage command value to the actuator 63.

The actuator 63 applies force corresponding to the voltage applied from the driver 77 to the pressing unit 61. A displacement of the pressing unit 61 caused by the force applied by the actuator 63 is detected by the encoder 64.

A response frequency of a current control feedback loop (a minor loop) is sufficiently higher than a response frequency of a speed control feedback loop (an intermediate loop) that is on the outside of the former. The response frequency of the speed control feedback loop (the intermediate loop) is sufficiently higher than a response frequency of a position control feedback loop (a major loop) that is on the outside of the former.

A band of the response frequency of an inside feedback loop is, for example, a frequency band 5 to 10 times or more higher than a band of the response frequency of a feedback loop that is on the outside of the former. With this configuration, an influence of phase delay caused by filters and discretization is reduced to stabilize the feedback control.

The target position P of the pressing unit 61 is determined by various methods in accordance with, for example, the performance of the image forming apparatus 10, requests by a user, and characteristics of the transfer sheet S and the intermediate transfer belt 12. As an example, the target position P of the pressing unit 61 is determined by the thickness of the transfer sheet S in order to suppress the speed fluctuations of the intermediate transfer belt 12 caused by the rush of the transfer sheet S into the nip.

In this case, the pressing controller 70 acquires the thickness of the transfer sheet S rushing into the nip in between the secondary transfer roller 25 and the intermediate transfer belt 12 looped over the repulsive force roller 15 and calculates the target position P of the pressing unit 61 corresponding to the thickness of the transfer sheet S. The thickness of the transfer sheet S is acquired by various methods.

As illustrated in FIG. 4, the image forming apparatus 10 further includes a sheet thickness sensor 85, an input unit 86, and a storage unit 87. The sheet thickness sensor 85, the input unit 86, and the storage unit 87 are examples of a sheet information acquisition unit.

The sheet thickness sensor 85 is arranged on the upstream side of the secondary transfer roller 25 in the conveying path of the transfer sheet S. The sheet thickness sensor 85 detects the thickness of the transfer sheet S conveyed and outputs a signal to the pressing controller 70. Based on the output signal of the sheet thickness sensor 85, the pressing controller 70 calculates the target position P of the pressing unit 61 corresponding to the thickness of the transfer sheet S. The pressing controller 70 feedback-controls the actuator 63 so as to control the pressing unit 61 to be the calculated target position P.

With this configuration, the sheet thickness sensor 85 can determine the thickness of the sheet in real time, and the pressing controller 70 can perform flexible control.

The pressing controller 70 is not limited to this example. For example, information on a plurality of target positions P of the pressing unit 61 corresponding to information on the transfer sheet S is stored in advance in the storage unit 87. The input unit 86 receives input of information on the transfer sheet S from the user.

When the user inputs the information on the transfer sheet S to the input unit 86, the pressing controller 70 acquires the information on the target position P of the pressing unit 61 corresponding to the information on the transfer sheet S from the storage unit 87. The pressing controller 70 feedback-controls the actuator 63 so as to control the pressing unit 61 to be the acquired target position P. Thus, the target position P of the pressing unit 61 may be determined based on sheet information (the thickness of the transfer sheet S) stored in advance.

In this case, a sheet timing sensor using a reflection-type limit sensor or the like may be used as the unit for detecting timing when the transfer sheet S rushes into the nip of the secondary transfer in place of the sheet thickness sensor 85, and based on its signal, the target position P of the pressing unit 61 may be changed.

Such a configuration eliminates sensing by the sheet thickness sensor 85 and can increase the speed of the control of the pressing controller 70.

In addition to the storing of the sheet information in the storage unit 87 in advance, the sheet information may be stored in a server. Specifically, the input unit 86 receives input of the information on the transfer sheet S (the designation of a sheet, for example) from the user. In this situation, when the user inputs the information on the transfer sheet S to the input unit 86, the pressing controller 70 attempts to acquire the information on the target position P of the pressing unit 61 corresponding to the information on the transfer sheet S from the storage unit 87. If the pressing controller 70 determines that the information on the target position P of the pressing unit 61 corresponding to the information on the transfer sheet S is not stored in the storage unit 87, the pressing controller 70 requests the information on the transfer sheet S from a certain server using a network I/F provided to the image forming apparatus. The server acquires the requested information on the transfer sheet S from a database and transmits the information on the transfer sheet S to the image forming apparatus that issued the request.

The image forming apparatus receives the information on the transfer sheet S transmitted from the server from the network I/F and notifies the pressing controller 70 of the information. The pressing controller 70 stores the received information on the transfer sheet S in the storage unit 87 and acquires the target position P. The pressing controller 70 feedback-controls the actuator 63 so as to control the pressing unit 61 to be the acquired target position P. Thus, if the sheet information is absent in the storage unit 87, the sheet information may be acquired from a server or an information processing apparatus provided separately. Such a configuration can handle new sheets and add information to conventional sheets, thus improving the convenience of users.

Figure 6:
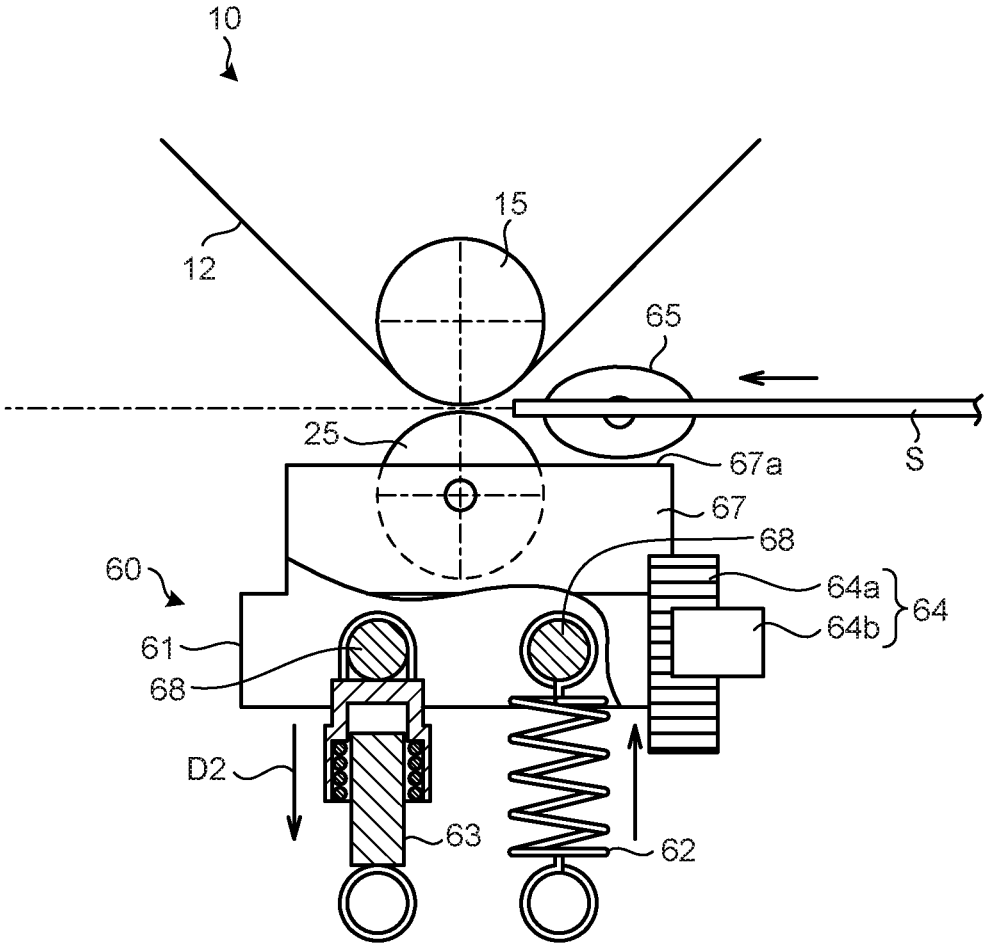
FIG. 6 is a side view illustrating an example of operation of the pressing apparatus of the first embodiment.

When the sheet thickness sensor 85 detects the thickness of the transfer sheet S conveyed, for example, the pressing controller 70 determines the target position P in accordance with the thickness of the transfer sheet S. FIG. 6 is a side view illustrating an example of operation of the pressing apparatus 60 of the first embodiment. As illustrated in FIG. 6, when the transfer sheet S is a piece of thick paper, for example, in order to suppress the speed fluctuations of the intermediate transfer belt 12 when the transfer sheet S rushes into the nip, the secondary transfer roller 25 and the intermediate transfer belt 12 are separated from each other to widen a gap therebetween. When the thickness of the transfer sheet S is known in advance, the target position P may be set, and the secondary transfer roller 25 and the intermediate transfer belt 12 may be separated from each other before the sheet thickness sensor 85 or the sheet timing sensor detects the transfer sheet S.

In this case, the pressing controller 70 sets a position at which the secondary transfer roller 25 is separate from the intermediate transfer belt 12 by, for example, 0.5 mm to be the target position P in accordance with the thickness of the transfer sheet S. The pressing controller 70 feedback-controls the actuator 63 so that the pressing unit 61 is arranged at the target position P.

The feedback control by the pressing controller 70, for example, causes the actuator 63 to move a secondary transfer unit being in contact with the intermediate transfer belt 12 in the second direction D2. The actuator 63 applies force exceeding the force with which the spring 62 pushes the pressing unit 61 to the pressing unit 61, thereby moving the pressing unit 61 in the second direction D2.

When the pressing unit 61 is arranged at the target position P, the actuator 63 applies the force that is equal to the force with which the spring 62 pushes the pressing unit 61 and that is toward the second direction D2 to the pressing unit 61. With this configuration, the force of the spring 62 and the force of the actuator 63 are cancelled out, and the pressing unit 61 is maintained at the target position P.

When the transfer sheet S is sufficiently thin, the pressing controller 70, for example, sets a position at which the secondary transfer roller 25 is pressed against the intermediate transfer belt 12 with an appropriate transfer pressure to be the target position P. The pressing controller 70 feedback-controls the actuator 63 and controls the pressing unit 61 to be the target position P, thereby maintaining the transfer pressure between the secondary transfer roller 25 and the intermediate transfer belt 12 at an appropriate level.

Furthermore, the pressing unit 61 can vibrate by the rush of the transfer sheet S into the nip or external force acting on the image forming apparatus 10. The pressing controller 70 acquires a displacement of the pressing unit 61 caused by the vibration through the output of the encoder 64.

The pressing controller 70 feedback-controls the actuator 63 based on the displacement of the pressing unit 61 and a speed obtained from the displacement, thereby controlling the pressing unit 61 to be the target position P. In other words, the pressing controller 70 feedback-controls the actuator 63 so as to attenuate the vibration of the pressing unit 61.

Figure 7:
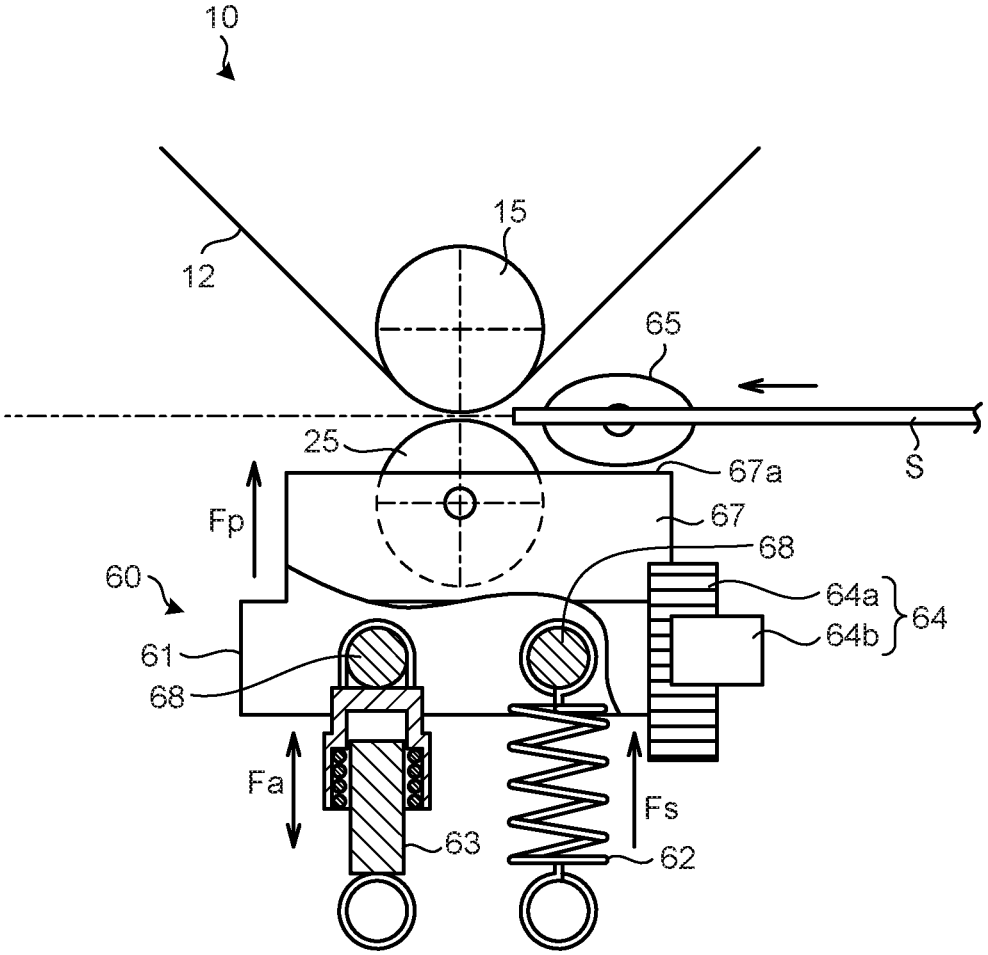
FIG. 7 is a side view illustrating a part of the image forming apparatus transferring a toner image to a transfer sheet in the first embodiment.

FIG. 7 is a side view illustrating a part of the image forming apparatus 10 transferring a toner image to the transfer sheet S in the first embodiment. As illustrated in FIG. 7, when the transfer sheet S enters the nip in between the secondary transfer roller 25 and the intermediate transfer belt 12, the secondary transfer roller 25 presses the transfer sheet S against the intermediate transfer belt 12.

Force (transfer pressure) Fp with which the secondary transfer roller 25 presses the transfer sheet S against the intermediate transfer belt 12 is, for example, represented by the following Equation (1).

$$Fp=Fs+Fa \tag{1}$$

In Equation (1), Fs is the force applied by the spring 62 to the pressing unit 61. Fa is the force applied by the actuator 63 to the pressing unit 61. Any force other than the force Fs and the force Fa may be added to the transfer pressure Fp. The force Fs and the force Fa are, for example, represented by the following Equation (2) and Equation (3), respectively.

$$Fs=k\times x \tag{2}$$

$$Fa=Kf\times I \tag{3}$$

k is a spring constant of the spring 62. x is an expansion and contraction amount of the spring 62. Kf is a thrust constant of the actuator 63. I is the current flowing through the actuator 63. The pressing controller 70 can adjust the transfer pressure Fp by changing the value of the current I flowing through the actuator 63.

In the above description, by controlling the target position P of the pressing unit 61, the current I is changed to control the transfer pressure Fp. In this case, a pressing amount equivalent to the transfer pressure Fp, that is, the target position P is determined and set from the spring constant of the spring 62 and a spring constant of the nip. The pressing amount is calculated so as to be the transfer pressure Fp considering the thickness of the transfer sheet S. During contact, the control system may be changed to only the current control or the current control and the speed control with a target speed of 0 to perform feedback control with the value of the current I equivalent to the transfer pressure Fp as a target.

Figure 14:
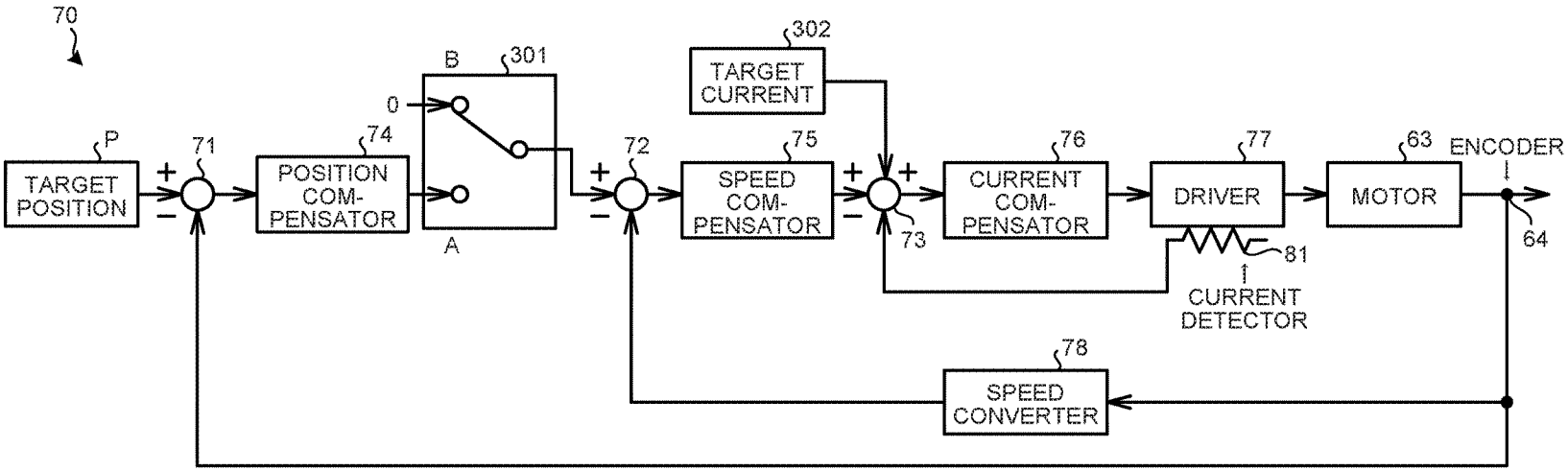
FIG. 14 is a block diagram illustrating another configuration example (No. 1) of the pressing controller.

The following describes operation with reference to a block diagram in FIG. 14. FIG. 14 is a positioning system that includes the current control and the speed control as minor loops in order to improve vibration attenuation and includes a switching unit 301 that switches between control systems.

When a state of separation is held, when the state of separation is changed to a state of contact, or when the state of contact is changed to the state of separation, positioning control for following a desired target position is performed. When the positioning is performed, the switching unit 301 is set to an A side. The following describes operation when the switching unit 301 is set to the A side.

The target position and the displacement (position) of the pressing unit 61 detected and fed back by the encoder 64 are compared with each other by the comparator 71, and the position deviation is output. The position deviation is input to the position compensator 74, and the speed command value is output. The speed command value passes through the switching unit 301 and is compared with the speed of the pressing unit 61 by the comparator 72, and the speed deviation is output. The speed of the pressing unit 61 is calculated by the speed converter 78 from the displacement of the pressing unit 61 detected by the encoder 64.

The speed deviation is input to the speed compensator 75, and the current command value is output. The current command value is input to the comparator 73 and is compared with the output of the current detector 81 that detects a current flowing through the actuator, and the current deviation is output. The current deviation is input to the current compensator 76, outputs the voltage command value, drives the driver 77, and drives the actuator 63 at a voltage equivalent to the voltage command value. With this operation, the pressing unit 61 can be positioned at the desired target position.

The following describes a case of performing force control at a desired transfer pressure Fp after the contact. After being positioned at the desired position of the state of contact, the switching unit 301 is switched to a B side to switch to a control system including speed feedback and current feedback. In this situation, a target speed of 0 is input from the B side of the switching unit. By setting the target speed to be 0, the performance (attenuation performance) of suppressing the vibration of the pressing unit 61 can be improved. The target speed passes through the switching unit 301 and is compared with the speed of the pressing unit 61 by the comparator 72, and the speed deviation is output.

The speed of the pressing unit 61 is calculated by the speed converter 78 from the displacement of the pressing unit 61 detected by the encoder 64. The speed deviation is input to the speed compensator 75, and the current command value is output. The current command value and a target current value 302 equivalent to the transfer pressure Fp are input to the comparator 73 and are compared with the output of the current detector 81 that detects a current flowing through the actuator, and the current deviation is output. The current deviation is input to the current compensator 76, outputs the voltage command value, drives the driver 77, and drives the actuator 63 at a voltage equivalent to the voltage command value. With this operation, the pressing unit 61 is pressed at a pressure equivalent to the transfer pressure Fp.

In order to improve the vibration attenuation performance of the pressing unit 61, the speed compensator 75 may be changed when the switching unit 301 is switched to the B side to perform the force control.

Although a form is described having the speed control system in order to improve the vibration attenuation performance, a form having only the current feedback performing the force control may be adopted. In this case, with the current command value output from the speed compensator 75 set to be zero, the target current value 302 equivalent to the transfer pressure Fp is input to the comparator 73 and is compared with the output of the current detector 81, and the current deviation is output. The current deviation in input to the current compensator 76, outputs the voltage command value, drives the driver 77, and drives the actuator 63 at a voltage equivalent to the voltage command value. With this operation, the pressing unit 61 is pressed at a pressure equivalent to the transfer pressure Fp.

The transfer pressure Fp larger than the force Fs of the spring 62 may be required, for example, depending on the type of the transfer sheet S. In this case, the pressing controller 70 passes the current I so as to cause the actuator 63 to apply force toward the first direction D1 to the pressing unit 61. With this operation, the force Fa of the actuator 63 is added to the force Fs of the spring 62 to increase the transfer pressure Fp up to a desired value.

In contrast, the transfer pressure Fp smaller than the force Fs of the spring 62 may be required depending on the type of the transfer sheet S. In this case, the pressing controller 70 passes the current I so as to cause the actuator 63 to apply force toward the second direction D2 to the pressing unit 61. With this operation, the force Fa of the actuator 63 decreases the force Fs of the spring 62 to decrease the transfer pressure Fp down to a desired value.

In the image forming apparatus 10 according to the first embodiment, the spring 62 and the actuator 63 are mounted on the pressing unit 61 and apply forces. The actuator 63 is feedback-controlled by the pressing controller 70 based on the parameter containing the position (displacement), speed, and force of the pressing unit 61 acquired by the encoder 64. With this configuration, the force with which the secondary transfer roller 25 of the pressing unit 61 is pressed against the intermediate transfer belt 12 is set with high precision and good responsiveness.

The force (transfer pressure) with which the secondary transfer roller 25 of the pressing unit 61 is pressed against the intermediate transfer belt 12 is obtained by the force of the spring 62 and the force of the actuator 63 controllable to a desired value. With this configuration, even when a strong spring 62 or a weak spring 62 is used, the actuator 63 is controlled to obtain a desired transfer pressure. The strong spring 62 increases the mechanical resonance frequency of the pressing unit 61. In contrast, the weak spring 62 reduces the manufacturing cost of the image forming apparatus 10.

The pressing controller 70 feedback-controls the actuator 63 based on the parameter containing the position (displacement) of the pressing unit 61. The pressing controller 70 feedback-controls the actuator 63 based on the parameter containing the speed of the pressing unit 61. With this configuration, the pressing unit 61 is positioned, and desired values are obtained for the transfer pressure of the secondary transfer roller 25 and the timing when the secondary transfer roller 25 is pressed against the intermediate transfer belt 12. Furthermore, the disturbance caused by the rush of the transfer sheet S into the nip and the vibration of the pressing unit 61 can be suppressed.

The pressing controller 70 feedback-controls the actuator 63 based on the speed of the pressing unit 61, thereby virtually increasing an attenuation coefficient. With this configuration, the vibration of the pressing unit 61 attenuates more effectively.

The pressing controller 70 feedback-controls the actuator 63 based on the current flowing through the actuator 63. With this configuration, a desired value is obtained for the transfer pressure of the secondary transfer roller 25, and the disturbance caused by the rush of the transfer sheet S into the nip is suppressed. Furthermore, high responsiveness and robustness against parameter fluctuations are obtained for the control of the actuator 63.

The transfer pressure of the secondary transfer roller 25 is adjusted, thereby obtaining the transfer pressure appropriate for transfer conditions of toner images. With this configuration, the secondary transfer roller 25 is not required to apply an excessive transfer pressure, and energy consumption of the image forming apparatus 10 can be reduced.

The image forming apparatus 10 includes the pressing apparatus 60, thereby finely controlling the transfer pressure of the secondary transfer roller 25, the gap between the secondary transfer roller 25 and the intermediate transfer belt 12, and operation timing of the pressing unit 61. With this configuration, disturbances caused by, for example, the rush of the transfer sheet S into the nip are suppressed, and an appropriate transfer pressure can be set in accordance with the type of the transfer sheet S. Consequently, image abnormalities caused by load fluctuations or vibration of the intermediate transfer belt 12 are reduced, thus achieving the image forming apparatus 10 that can set more appropriate transfer conditions.

The pressing controller 70 controls the actuator 63 based on the thickness of the transfer sheet S, thereby separating the secondary transfer roller 25 from the intermediate transfer belt 12. With this configuration, load fluctuations and speed fluctuations of the intermediate transfer belt 12 when the transfer sheet S enters the nip in between the secondary transfer roller 25 and the intermediate transfer belt 12 are suppressed.

In the first embodiment, the spring 62 is a compression spring that extends from the beam 68 substantially downward and pushes the pressing unit 61 upward. The spring 62 is not limited to this example and may be a tension spring that extends from the beam 68 substantially upward and pulls the pressing unit 61 upward. Similarly, the actuator 63 may extend from the beam 68 substantially downward as illustrated in FIG. 4 or extend from the beam 68 substantially upward.

Figure 15:
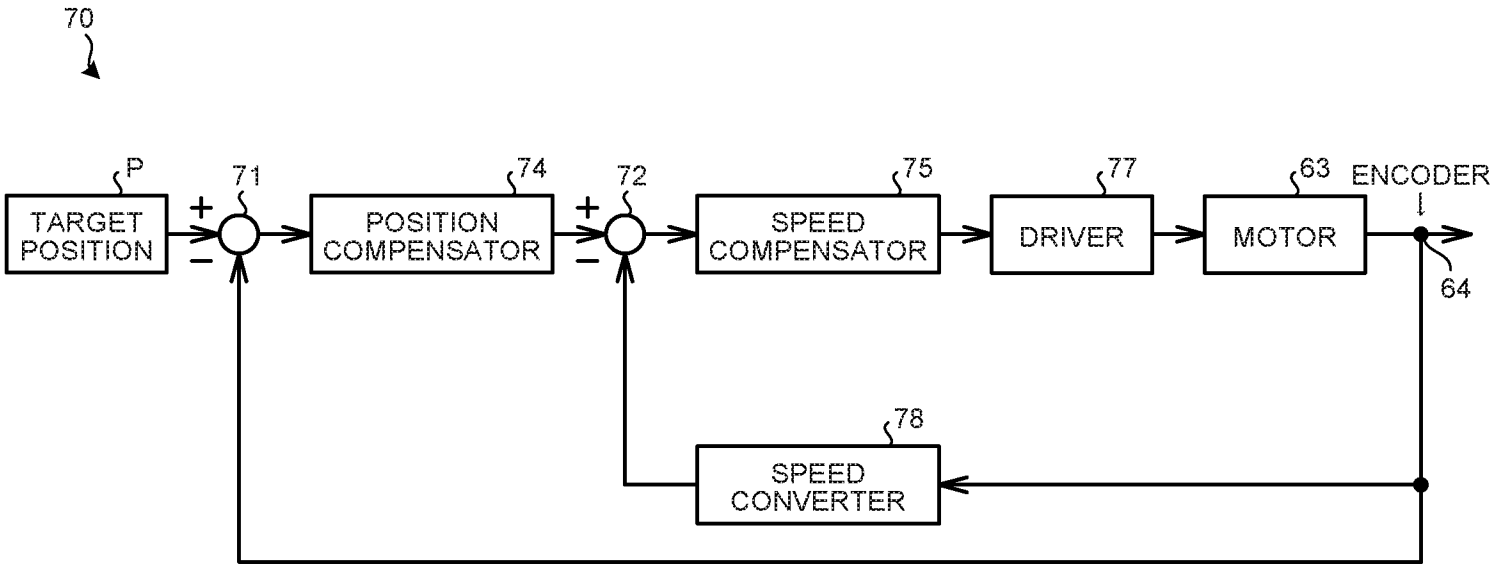
FIG. 15 is a block diagram illustrating another configuration example (No. 2) of the pressing controller.

Although the block diagram of FIG. 5 described in the first embodiment is a form including the current control feedback, a voltage control-type control system without the current control feedback may be adopted when a pressing amount equivalent to the transfer pressure Fp is controlled, or when the current and the voltage are nearly proportional to each other. Specifically, the voltage control-type control system is illustrated with a block diagram of FIG. 15. The controller 70 includes the comparators 71, 72, the position compensator 74, the speed compensator 75, the driver 77, and the speed converter 78.

In the case of the voltage control type, an induced voltage proportional to a speed or angular speed of the actuator is required to be considered. The speed compensator of FIG. 15 compensates for the induced voltage and generally differs in the type and constant of a filter from the speed compensator 75 of FIG. 5. Output of the speed compensator is a value equivalent to a voltage passed by the driver 77 to the actuator 63.

Figure 8:
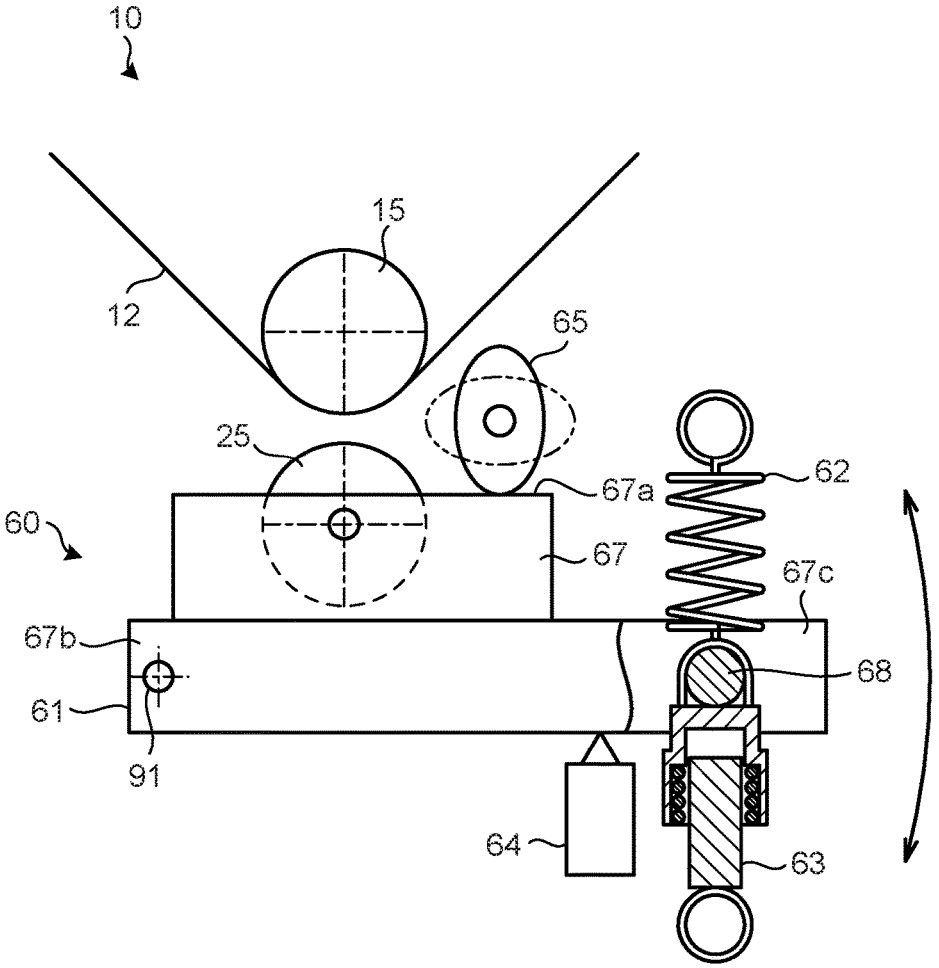
FIG. 8 is a side view illustrating a part of the image forming apparatus including the pressing apparatus according to a second embodiment.
Figure 9:
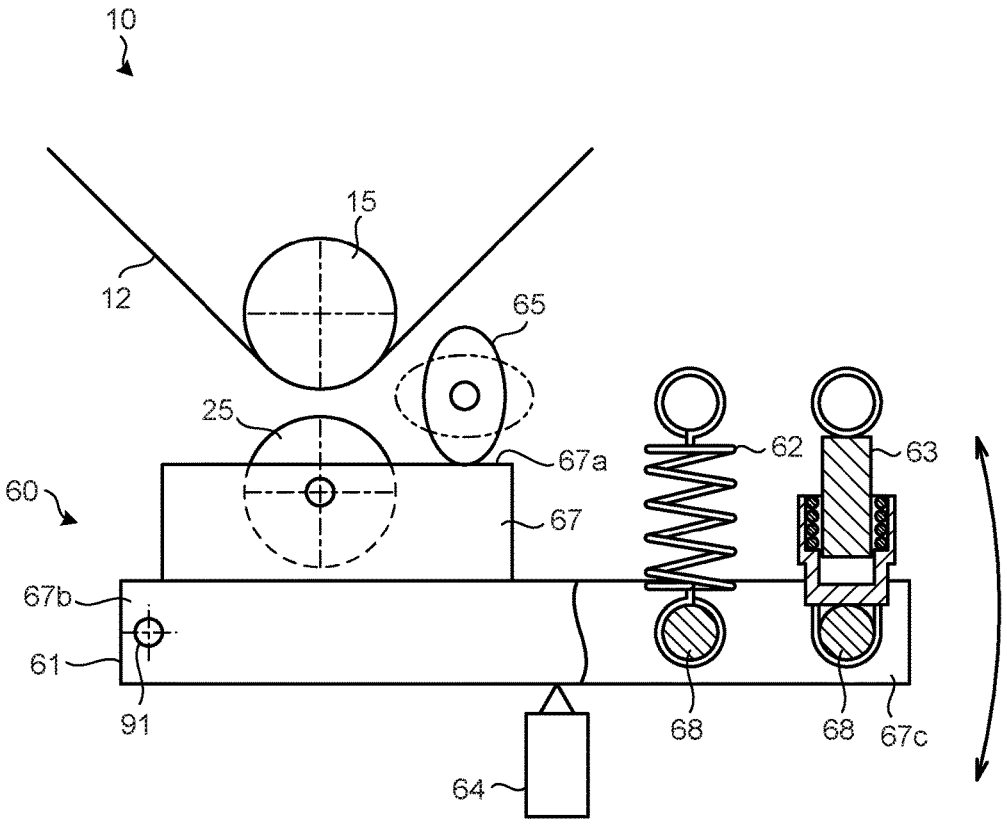
FIG. 9 is a side view illustrating a part of the image forming apparatus including a first modification of the pressing apparatus of the second embodiment.
Figure 10:
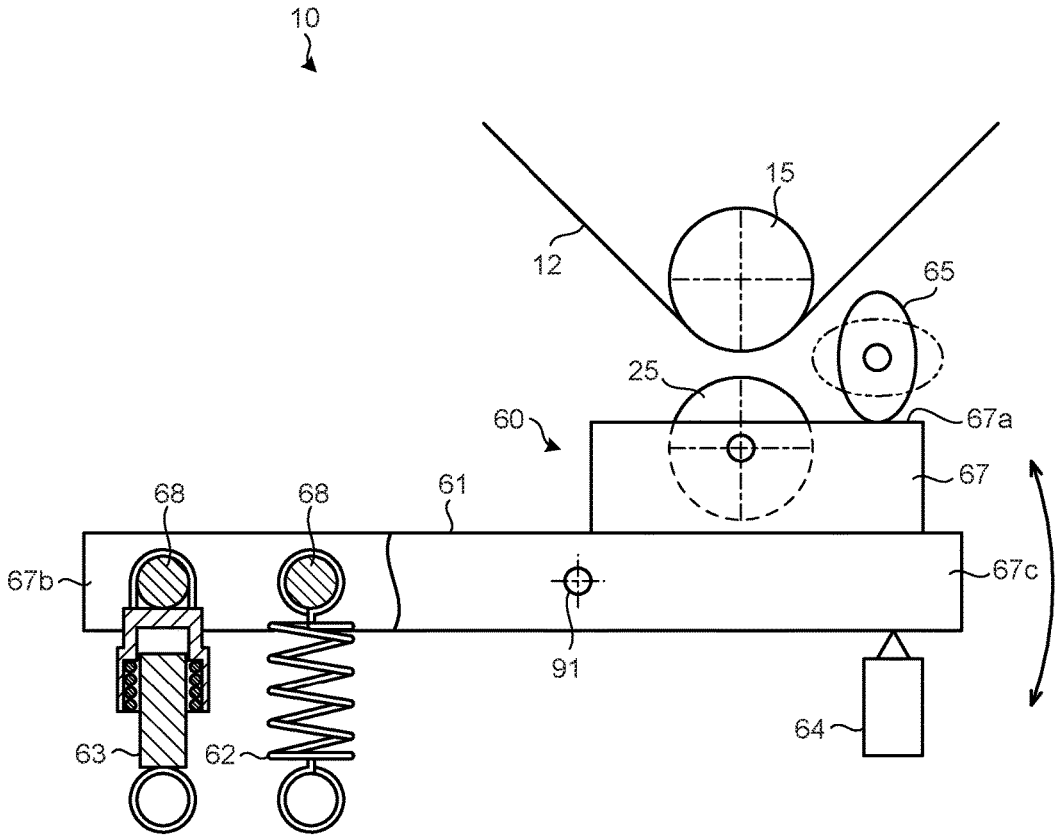
FIG. 10 is a side view illustrating a part of the image forming apparatus including a second modification of the pressing apparatus of the second embodiment.

The following describes a second embodiment with reference to FIG. 8 to FIG. 10. In descriptions of a plurality of embodiments below, the same signs will be attached to components having similar functions to those of the components already described, and descriptions thereof may be omitted. A plurality of components attached with the same signs do not necessarily share all functions and characteristics and may have different functions and characteristics depending on the respective embodiments.

FIG. 8 is a side view partially cutting out and schematically illustrating a part of the image forming apparatus 10 including the pressing apparatus 60 according to the second embodiment. As illustrated in FIG. 8, the pressing unit 61 of the second embodiment includes a rotating shaft 91. The rotating shaft 91 is an example of a fulcrum.

The rotating shaft 91 is fixed to, for example, the casing of the image forming apparatus 10. The rotating shaft 91 passes through one end 67*b* of the supporting member 67 of the pressing unit 61. The rotating shaft 91 may be arranged in another part of the pressing unit 61.

The pressing unit 61 is swingable about the rotating shaft 91. The pressing unit 61 swings, thereby causing the secondary transfer roller 25 to come close to or separate from the intermediate transfer belt 12 looped over the repulsive force roller 15. In other words, the pressing unit 61 is an example of a swingable member.

The beam 68 is arranged on another end 67*c* of the supporting member 67. One end of the spring 62 is mounted on the beam 68. One end of the actuator 63 is also mounted on the same beam 68.

The spring 62 in FIG. 8 is a tension spring. The spring 62 extends from the beam 68 substantially upward. The spring 62 applies force in a direction (the upper direction in FIG. 8) in which the secondary transfer roller 25 comes close to the repulsive force roller 15 over which the intermediate transfer belt 12 is looped to the pressing unit 61. In other words, the spring 62 pulls the secondary transfer roller 25 toward the repulsive force roller 15 and the intermediate transfer belt 12 looped over the repulsive force roller 15.

The spring 62 supports the pressing unit 61 and performs gravity compensation of the pressing unit 61. Furthermore, the spring 62 pulls the secondary transfer roller 25 toward the repulsive force roller 15 and the intermediate transfer belt 12, thereby generating a transfer pressure between the secondary transfer roller 25 and the intermediate transfer belt 12.

The actuator 63 is a translation actuator similarly to the first embodiment. The actuator 63 extends from the beam 68 substantially downward. In other words, the actuator 63 in FIG. 8 extends in the direction opposite the spring 62. The actuator 63 applies force to the pressing unit 61 in accordance with a current passed therethrough.

The encoder 64 in the second embodiment is, for example, a contact displacement meter. The encoder 64 is in contact with the supporting member 67, detects the displacement of the pressing unit 61, and output a pulse. The encoder 64 is not limited to this example and may be, for example, the same linear encoder as in the first embodiment.

The secondary transfer roller 25 is arranged in between the one end 67*b* and the other end 67*c* of the supporting member 67 in the longitudinal direction (the transverse direction in FIG. 8) of the pressing unit 61. Given this configuration, the distance between a position at which the actuator 63 is mounted on the pressing unit 61 and the rotating shaft 91 is longer than the distance between a position at which the secondary transfer roller 25 is mounted on the pressing unit 61 and the rotating shaft 91.

FIG. 9 is a side view partially cutting out and schematically illustrating a part of the image forming apparatus 10 including a first modification of the pressing apparatus 60 of the second embodiment. As illustrated in FIG. 9, one end of the actuator 63 of the first modification is mounted on the beam 68 different from the beam on which the spring 62 is mounted.

The actuator 63 extends from the beam 68 substantially upward similarly to the spring 62. The actuator 63 of the first modification also applies force to the pressing unit 61 in accordance with a current passed therethrough similarly to the above-described actuator 63. In other words, the actuator 63 applies the force to the pressing unit 61 in a direction in which the secondary transfer roller 25 comes close to or separates from the repulsive force roller 15 over which the intermediate transfer belt 12 looped.

The beam 68 on which the actuator 63 is mounted is more separate from the rotating shaft 91 than the beam 68 on which the spring 62 is mounted. The distance between a position at which the actuator 63 is mounted on the pressing unit 61 and the rotating shaft 91 is longer than the distance between a position at which the spring 62 is mounted on the pressing unit 61 and the rotating shaft 91.

FIG. 10 is a side view partially cutting out and schematically illustrating a part of the image forming apparatus 10 including a second modification of the pressing apparatus 60 of the second embodiment. As illustrated in FIG. 10, the rotating shaft 91 of the second modification is arranged in between the one end 67*b* and the other end 67*c* of the supporting member 67.

The two beams 68 are arranged at positions closer to the one end 67*b* of the supporting member 67 than the rotating shaft 91. One end of the actuator 63 is mounted on the beam 68 closer to the one end 67*b* of the supporting member 67. One end of the spring 62 is mounted on the beam 68 closer to the rotating shaft 91.

The secondary transfer roller 25 is arranged at a position closer to the other end 67*c* of the supporting member 67 than the rotating shaft 91. In other words, the rotating shaft 91 is arranged in between the secondary transfer roller 25 and the spring 62 and the actuator 63.

The actuator 63 of the second modification is controlled by the pressing controller 70 similarly to the first embodiment. The pressing controller 70 performs feedback control of the actuator 63 based on the position (displacement) of the pressing unit 61, the speed of the pressing unit 61, and the current flowing through the actuator 63.

In the image forming apparatus 10 of the second embodiment, the distance between a position at which the actuator 63 is mounted on the pressing unit 61 and the rotating shaft 91 is longer than the distance between a position at which the secondary transfer roller 25 is mounted on the pressing unit 61 and the rotating shaft 91. With this configuration, the transfer pressure of the secondary transfer roller 25 is larger than the force applied by actuator 63 to the pressing unit 61. Consequently, a small-sized, low-priced actuator 63 can be used, which increases the degree of freedom of the layout of the image forming apparatus 10 and reduces the manufacturing cost thereof. Furthermore, the energy consumption of the image forming apparatus 10 is reduced.

The distance between a position at which the actuator 63 is mounted on the pressing unit 61 and the rotating shaft 91 may be shorter than the distance between a position at which the secondary transfer roller 25 is mounted on the pressing unit 61 and the rotating shaft 91. In this case, a movable amount of the actuator 63 is reduced, and the degree of freedom of the layout of the image forming apparatus 10 is increased.

Figure 11:
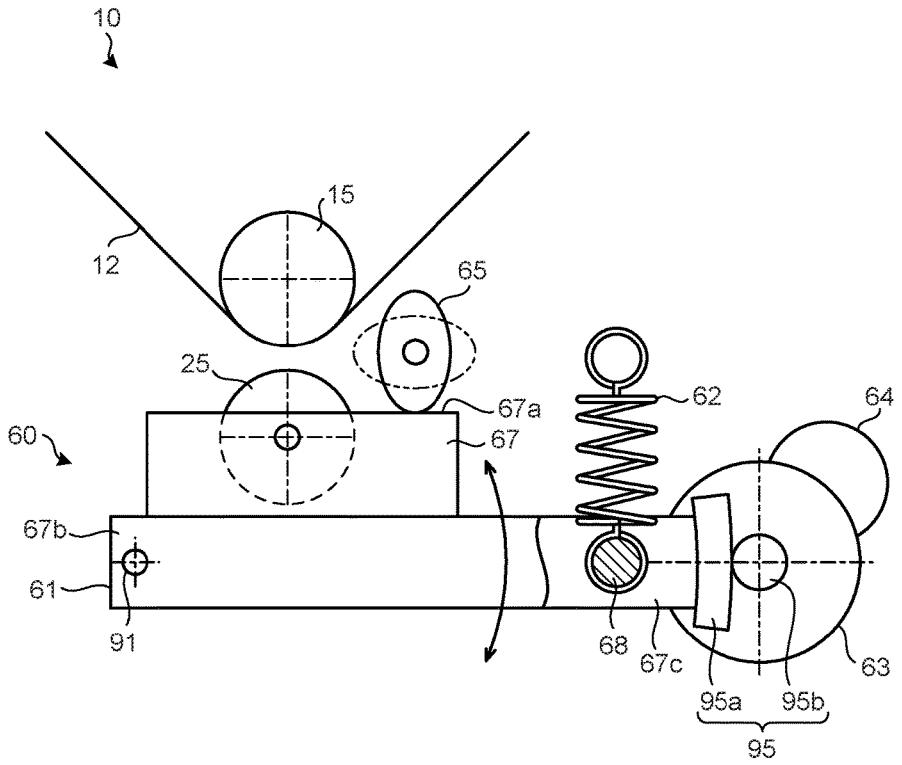
FIG. 11 is a side view illustrating a part of the image forming apparatus including the pressing apparatus according to a third embodiment.

The following describes a third embodiment with reference to FIG. 11. FIG. 11 is a side view partially cutting out and schematically illustrating a part of the image forming apparatus 10 including the pressing apparatus 60 according to the third embodiment. As illustrated in FIG. 11, the actuator 63 of the third embodiment is a rotary-type actuator.

The actuator 63 of the third embodiment is, for example, a general-purpose DC motor. The actuator 63 is not limited to this example and may be an AC motor. The actuator 63 may be a brush-equipped motor or a brushless motor. The actuator 63 may be another rotary-type actuator capable of controlling torque.

The rotating shaft 91 is arranged on the one end 67*b* of the supporting member 67. The actuator 63 is mounted on the other end 67*c* of the supporting member 67 through a transmission mechanism 95. The transmission mechanism 95 includes a gear 95*a* and a transmission gear 95*b*.

The gear 95*a* is formed on an end face of the other end 67*c* of the supporting member 67. The transmission gear 95*b* is mounted on a drive shaft of the actuator 63. The transmission gear 95*b* may be formed integrally with the drive shaft of the actuator 63.

When the actuator 63 is driven, the transmission gear 95*b* rotates by the drive shaft. The transmission gear 95*b* transmits torque of the actuator 63 to the pressing unit 61 through the gear 95*a*. With this operation, the pressing unit 61 swings about the rotating shaft 91 in accordance with a rotation direction of the drive shaft of the actuator 63.

The pressing unit 61 swings, thereby causing the secondary transfer roller 25 to come close to or separate from the intermediate transfer belt 12. In other words, the actuator 63 transmits the torque to the pressing unit 61, thereby applying force in a direction in which the secondary transfer roller 25 comes close to the intermediate transfer belt 12 or separates from the intermediate transfer belt 12 to the pressing unit 61.

The configuration of the transmission mechanism 95 is not limited to the above one. The transmission mechanism 95 may, for example, transmit the torque of the actuator 63 to the pressing unit 61 using another means such as friction, a belt, and a wire.

The spring 62 is mounted on the beam 68 provided on the other end 67*c* of the supporting member 67. The distance between a position at which the spring 62 is mounted on the pressing unit 61 and the rotating shaft 91 is shorter than the distance between the gear 95*a* and the rotating shaft 91.

The encoder 64 of the third embodiment is a rotary encoder. The encoder 64, for example, detects a rotation amount of the drive shaft of the actuator 63 and outputs an encoder pulse. The pressing controller 70 calculates the displacement of the pressing unit 61 from the rotation amount of the drive shaft of the actuator 63.

The actuator 63 of the third embodiment is controlled by the pressing controller 70 similarly to the first embodiment. The pressing controller 70 performs feedback control of the actuator 63 based on the position (displacement) of the pressing unit 61, the speed of the pressing unit 61, and the current flowing through the actuator 63.

In the image forming apparatus 10 of the third embodiment, the actuator 63 is a rotary-type actuator that is rotatingly driven to apply force to the pressing unit 61. The rotary-type actuator is generally lower in price than the translation-type actuator such as the one in the first embodiment. For this reason, the manufacturing cost of the pressing apparatus 60 including the actuator 63 as the rotary-type actuator is reduced.

The actuator 63 is arranged on the other end 67*c* of the supporting member 67. With this configuration, a larger reduction ratio is obtained, and the force with which the secondary transfer roller 25 is pressed against the intermediate transfer belt 12 is larger than the force applied by the actuator 63 to the pressing unit 61. Consequently, a small-sized, low-priced actuator 63 can be used, which increases the degree of freedom of the layout of the image forming apparatus 10 and reduces the manufacturing cost thereof. Furthermore, the energy consumption of the image forming apparatus 10 is reduced.

The arrangement of the secondary transfer roller 25, the spring 62, the actuator 63, and the rotating shaft 91 in the third embodiment is not limited to the arrangement illustrated in FIG. 11. The configuration and arrangement of the pressing apparatus 60 may be any such that the spring 62 can apply a desired force to the pressing unit 61 and that the actuator 63 can apply torque with a desired reduction ratio to the pressing unit 61.

Figure 12:
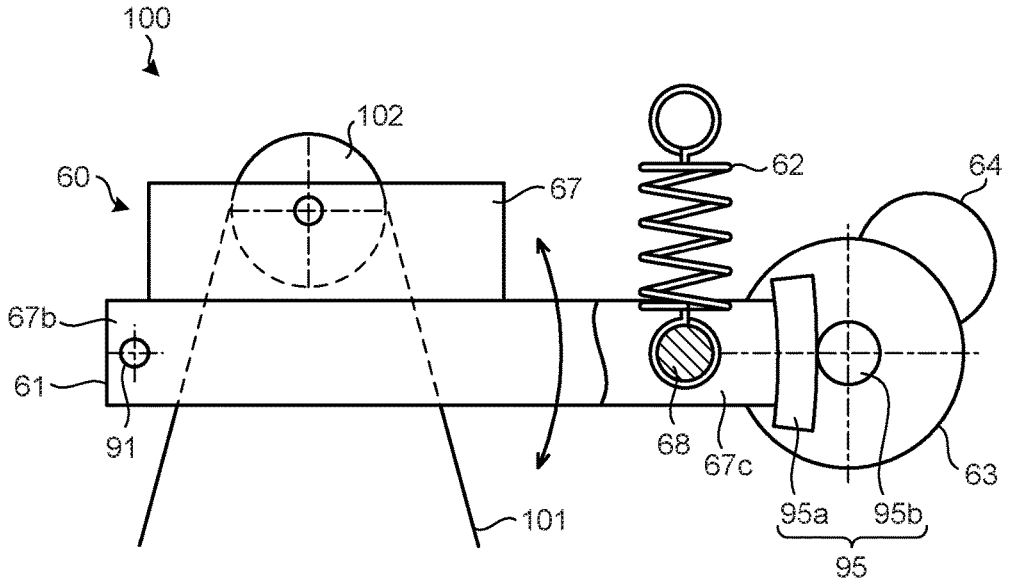
FIG. 12 is a side view illustrating a tension adjusting apparatus according to a fourth embodiment.

The following describes a fourth embodiment with reference to FIG. 12. FIG. 12 is a side view partially cutting out and schematically illustrating a tension adjusting apparatus 100 according to the fourth embodiment. The tension adjusting apparatus 100 is an example of the pressing apparatus.

The tension adjusting apparatus 100 applies a tension to a sheet-shaped or belt-shaped body and controls the tension to be a desired value. The tension adjusting apparatus 100, for example, applies a tension to a sheet 101. The sheet 101 is an example of the first member.

The tension adjusting apparatus 100 includes the pressing apparatus 60 similar to that of the third embodiment. The tension adjusting apparatus 100 includes a roller 102 in place of the secondary transfer roller 25. The roller 102 is rotatably supported by the supporting member 67 similarly to the secondary transfer roller 25. The sheet 101 is looped over the roller 102.

The spring 62 applies force in the direction in which the roller 102 comes close to the sheet 101 to the pressing unit 61. The actuator 63 applies force in the direction in which the roller 102 comes close to or separate from the sheet 101 to the pressing unit 61. The pressing controller 70 of the tension adjusting apparatus 100 controls the actuator 63, thereby controlling the force (tension) with which the roller 102 is pressed against the sheet 101.

The actuator 63 of the fourth embodiment is controlled by the pressing controller 70 similarly to the first embodiment. The pressing controller 70 performs feedback control of the actuator 63 based on the position (displacement) of the pressing unit 61, the speed of the pressing unit 61, and the current flowing through the actuator 63.

The tension adjusting apparatus 100 of the fourth embodiment is, for example, used for adjusting a tension of the intermediate transfer belt 12 of the image forming apparatus 10. In this case, for example, the sheet 101 is used for the intermediate transfer belt 12 of the image forming apparatus 10, whereas the roller 102 is used for the driven roller 14 of the image forming apparatus 10.

The tension adjusting apparatus 100 can be used for, not limited to the image forming apparatus 10, various apparatuses. The sheet 101 may be, for example, another body such as a continuous form sheet, paper, cloth, and film. In other words, the tension adjusting apparatus 100 can be used for sheet feeding systems of image forming apparatuses for continuous form sheets or conveying systems of machines that manufacture paper, cloth, or film.

Figure 13:
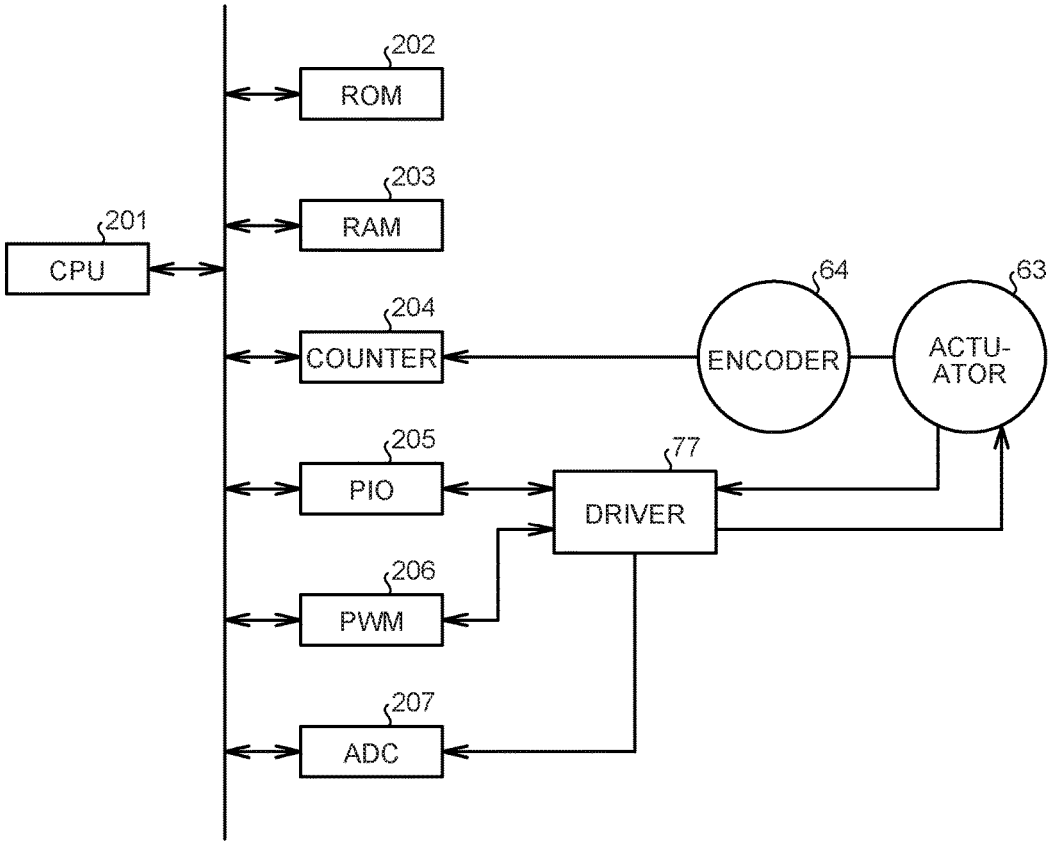
FIG. 13 is a block diagram illustrating an example of a configuration for performing feedback control computation in the embodiments.

FIG. 13 is a block diagram illustrating an example of a configuration for performing feedback control computation in the embodiments. FIG. 13 also illustrates the actuator 63, the encoder 64, and the driver 77 for illustration.

Computing circuits, memories, or the like of the embodiments can be implemented by not only electronic hardware such as logic circuits and FPGA but also software. FIG. 13 illustrates an example of a configuration that operates the software.

As illustrated in FIG. 13, a bus 200 connects a calculator such as a CPU 201, memories such as a ROM 202 and a RAM 203, a counter 204, a programmed I/O (PIO) 205, a PWM generator (illustrated as PWM in FIG. 13) 206, and a peripheral device such as an analog-to-digital converter (ADC) 207 in a mutually communicable manner.

The ROM 202 stores therein, for example, an operating program for the CPU 201 to control the entire configuration. The RAM 203 is used as a work memory and stores therein, for example, acquired information and computed results.

The operating program may be recorded and provided in a computer-readable storage medium such as a CD, an FD, a DVD, and a flash memory, as an installable or executable file.

Furthermore, the operating program may be stored in a computer connected to a network such as the Internet and provided by being downloaded via the network. The operating program may be provided or distributed via a network such as the Internet.

A control program for implementing the feedback control of the pressing apparatus 60 in the embodiments is modularized including the above units (the comparators 71, 72, 73, the position compensator 74, the speed compensator 75, the current compensator 76, and the speed converter 78 of FIG. 5). As actual hardware, the CPU 201 reads the program from the ROM 202 and executes it, thereby loading the units onto the RAM 203 and generating the comparators 71, 72, 73, the position compensator 74, the speed compensator 75, the current compensator 76, and the speed converter 78 on the RAM 203. The storage unit 87 in FIG. 4 can be configured using a certain area within the RAM 203.

The counter 204 counts the pulse of the encoder 64 or measures a pulse interval at a basic clock. By taking a difference of measured counted values or taking an inverse of a cycle, for example, the speed of the pressing unit 61 is calculated. Information indicating the calculated speed is supplied to the CPU 201.

The PIO 205 is an interface between the CPU 201 and the driver 77. The PIO 205 designates on and off of the driver 77, on and off of a brake, a drive direction of the actuator 63, or the like. Input of the driver 77 may be PWM input or analog input. For the PWM input, the PWM generator 206 inputs a PWM signal with a duty equivalent to a voltage or current driving the actuator 63 to the driver 77 in accordance with an instruction of the CPU 201. For the analog input, a digital-to-analog converter is used in place of the PWM generator 206.

The driver 77, for example, passes three-phase currents U, V, and W in accordance with logics of Hall signals HU, HV, and HW output from a Hall element mounted on the actuator 63 to drive the actuator 63. The encoder 64, as a detection system, detects movement of a mechanism driven by the actuator 63 and outputs an encoder pulse.

The CPU 201 performs computations of the position compensator 74, the speed compensator 75, the current compensator 76, and the speed converter 78 of FIG. 5 in accordance with a target value. The CPU 201 detects the current flowing through the actuator 63 by the current detector 81 and captures a current value by the ADC 207. The CPU 201 performs feedback control of the current based on the current value. In this case, a response frequency and a sampling frequency of the current control are set to be higher than a response frequency and a sampling frequency of the position and speed control by the encoder 64. The driver 77 may detect the current flowing through the actuator 63 by the current detector 81 and perform the feedback control of the current.

The above-described embodiments of the present invention do not limit the scope of the invention and are merely examples contained in the scope of the invention. An embodiment of the present invention may be one obtained by performing changes, omissions, and additions on the above-described embodiments to the extent without departing from the gist of the invention with respect to at least part of specific use, structure, shape, action, and effect.

In the above-described embodiments, for example, the actuator 63 is driven by electricity and applies force to the pressing unit 61. However, the actuator is not limited to this example and may be driven by another means such as oil pressure, air pressure, and water pressure. Furthermore, the spring 62 is not limited to a coil spring and may be another kind of spring such as a leaf spring.

In the above-described embodiments, the pressing controller 70 is a triple multi-loop control system including the current control, the speed control, and the position control. However, the pressing controller 70 may be a control system including a single or double feedback loops.

The pressing controller 70 may have, for example, only the feedback loop of the current control. In this case, the current deviation is calculated from a preset target current value and the current of the actuator 63 detected by the current detector 81. The current compensator 76 calculates the voltage command value based on the current deviation. The thus configured pressing controller 70 can appropriately control the transfer pressure of the secondary transfer roller 25.

The pressing controller 70 may have only the feedback loops of the current control and the speed control. In this case, the speed deviation is calculate from a preset target speed, which is, for example, 0 m/s and the speed of the pressing unit 61 calculated by the speed converter 78. The thus configured pressing controller 70 can rapidly attenuate the vibration of the pressing unit 61.

In the thus configured pressing controller 70, the output of the speed converter 78 may be multiplied by any value. With this operation, the attenuation coefficient is virtually reduced, and the vibration of the pressing unit 61 is attenuated more rapidly.

Furthermore, a preset target value may be added to the current command value output by the speed compensator 75. With this operation, the transfer pressure of the secondary transfer roller 25 can be controlled to be a value depending on the target value.

The pressing controller 70 includes the feedback loop of the current control. However, the pressing controller 70 may have a feedback loop of voltage control in place of the feedback loop of the current control.

The position compensator 74, the speed compensator 75, and the current compensator 76 of the pressing controller 70 are proportional integral (PI) compensators designed based on a classical control theory. The position compensator 74 may be a proportional (P) compensator.

The configuration of the pressing controller 70 illustrated in FIG. 5 is a feedback control system based on the classical control theory. The pressing controller 70 is not limited to this example and may be a state feedback control system based on a modern control theory or a feedback control system based on a robust control theory.

The following considers the following point in the configuration and control of the pressing apparatus 60. The second member (the secondary transfer roller 25 (the pressing apparatus 60)) that can come close to or separate from the first member (the repulsive force roller 15) includes the elastic member (the spring 62) and the actuator 63 that generate a desired force and is feedback-controlled based on the various parameters. However, when the target value of the feedback control system is changed stepwise, the following malfunction is considered.

First, a mechanical resonance frequency of an object to be controlled is excited, and convergence to the target value may worsen. A deviation relative to the target value is large, an operation amount output by a compensator increases, and a voltage or current passed through the actuator 63 is saturated, which may increase an overshoot or worsen the convergence to the target value. When the elastic member such as the spring 62 is used or when an elastic force of an abutment member largely acts through contact in particular, forces generated by the elastic member and an abutment member are compensated for by the actuator 63, and the voltage or current of the actuator 63 is likely to be saturated. In addition, voltage or current in a DC manner is required for the compensation of the forces generated by the elastic member and the abutment member, and there is nonlinearity that differs in force or torque to be generated for accelerating or decelerating drive between drive directions. This nonlinearity causes a problem in that the convergence to the target value worsens. In an apparatus having rigorous requirements for time for contact and time for separation, quick operation and stable convergence to the target value are required, which causes a problem of the saturation of voltage or current owing to restrictions in terms of cost and configurational restrictions.

Also when track generation is performed, it is desired that characteristic be easily changed in accordance with drive conditions and drive apparatuses. For products desired to be standardized for cost reduction or efficiency improvement in particular, it is desired that characteristics be changed only by changing constants.

Figure 16:
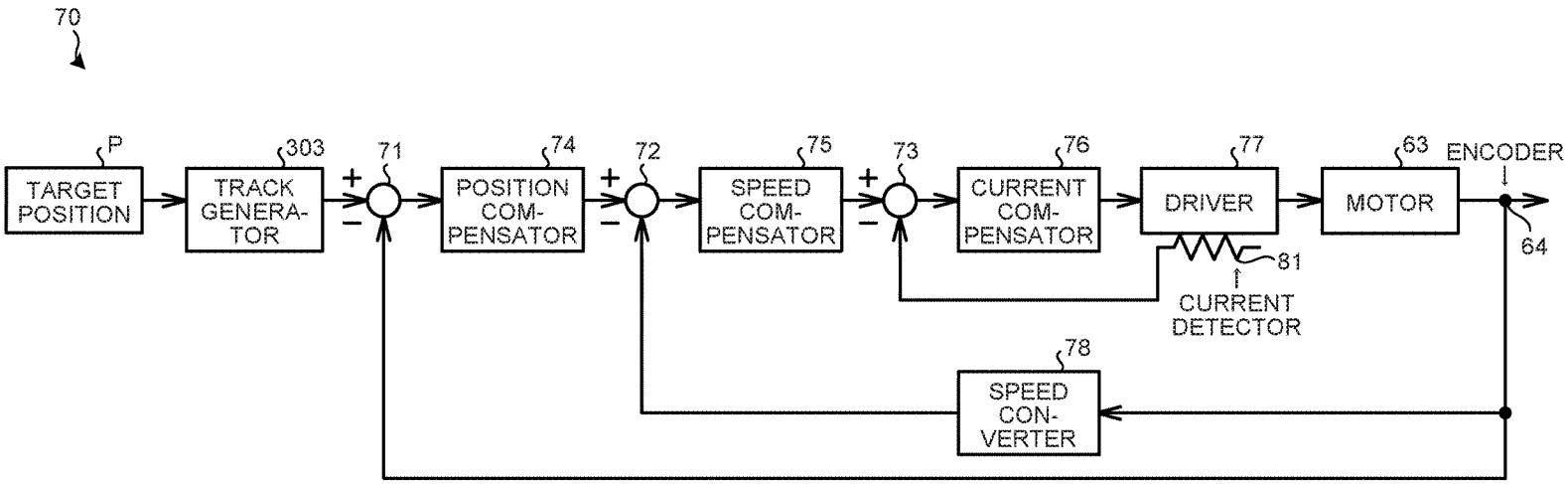
FIG. 16 is a block diagram illustrating another configuration example (No. 3) of the pressing controller.

The following describes a configuration example that considers the above malfunction. A configuration of a control system will be described with reference to FIG. 16. The configuration of the control system includes a target track generator 303 after the target position of FIG. 5. The track generator 303 is described as a data table that outputs a target track position in time series from a point of time when the target position changes. The data table is prepared in advance in accordance with characteristics of a mechanism or operation requests.

Figure 17:
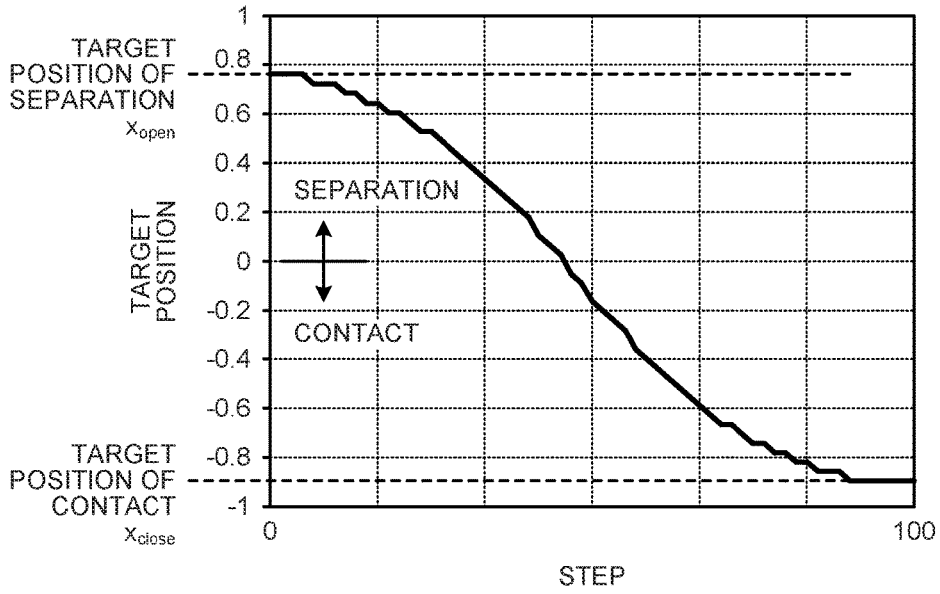
FIG. 17 is a data table illustrating an example of effecting operation from a separate position to a contact position.

FIG. 17 is a data table that effects operation from a separate position $X_{open}$ to a contact position $X_{close}$. When the contact position $X_{close}$ is input, the target track position is output as time-series data so as to come close to the contact position $X_{close}$ in accordance with a control step from the separate position $X_{open}$.

The data table changes from the separate position $X_{open}$ to the contact position $X_{close}$ in a prescribed time (a prescribed number of steps) and sets items designed in advance such as a track that reduces a mechanical resonance frequency of a mechanism and the shortest track that does not saturate voltage and current. FIG. 17 is a data table considering resolution of a detector. A plurality of data tables may be prepared depending on differences in the target position and differences in the prescribed time. The data table may be provided with the target position of the vertical axis normalized between the separate position $X_{open}$ to the contact position $X_{close}$ and with the prescribed time (the prescribed number of steps) of the horizontal axis normalized.

The following describes a case in which the track generator 303 is a filter. A filter of digital control is generally represented as a form discretized by a control step (a sampling frequency). This example is represented by a discretization transfer function shown by the following Equation (4).

$$\frac{Y(z)}{U(z)} = \frac{b_0 z^n + b_1 z^{n-1} + b_2 z^{n-2} + \ldots + b_n}{a_0 z^n + a_1 z^{n-1} + a_2 z^{n-2} + \ldots + a_n} \tag{4}$$

$$\frac{Y(z)}{U(z)} = \frac{b_0 + b_1 z^{-1} + b_2 z^{-2} + \ldots + b_n z^{-n}}{a_0 + a_1 z^{-1} + a_2 z^{-2} + \ldots + a_n z^{-n}}$$

where $z^{-1}$ indicates one sample delay. By changing constants $a_0$ to $a_n$ and $b_0$ to $b_n$ of the denominator and numerator of this filter, filter characteristics can be changed.

When, with n=9, $a_0$=1, $a_1$ to $a_9$=0, and $b_0$ to $b_9$=0.1, for example, a 10-times moving average filter (FIR filter) is obtained. In addition, primary or secondary low-pass filters (IIR filters) can be set depending on setting. When a primary low-pass filter having a cutoff frequency of 100 Hz is represented by the discretization transfer function having a sampling frequency of 1 kHz, for example, with n=1, $a_0$=1, $a_1$=−0.5335, $b_0$=0, and $b_1$=0.4665.

Although the FIR and the IIR low-pass filters are described above, a band-stop filter, which cuts a specific frequency, or a band-pass filter, which passes a specific frequency, can also be set. They may be multiplied across a plurality of steps (connected in a cascade manner). The characteristic of FIG. 17 is a result obtained by stepwise input to three-step multiplication of moving average filters of a desired number of times.

Figure 18:
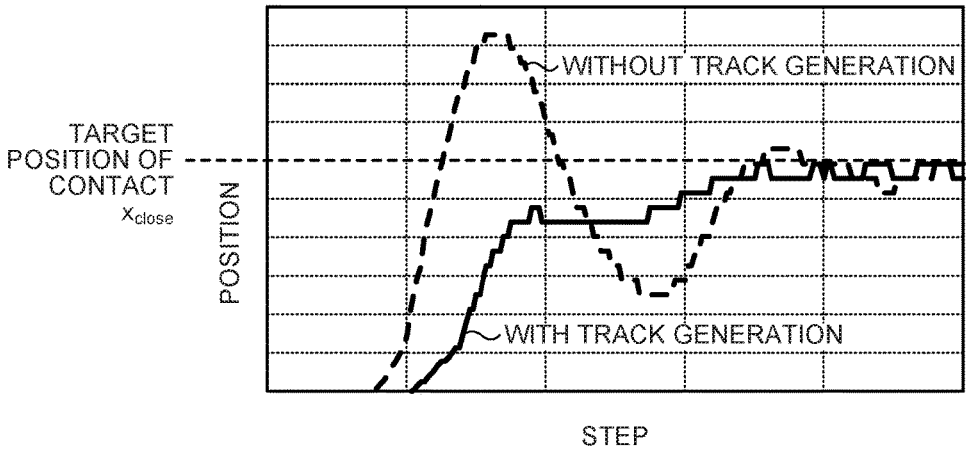
FIG. 18 is a graph illustrating response results of a mechanism unit of an object to be controlled when a target track position that changes in time series by a track generator is used and when a target position is changed stepwise without using any track generator.

FIG. 18 is a graph illustrating response results of a mechanism unit of an object to be controlled when a target track position that changes in time series by a track generator is used and when a target position is changed stepwise without using any track generator. In the case without track generation, the target position applied to the feedback control system largely changes to increase an operation amount of the output of a compensator, and voltage or current is saturated, leading to an inability to perform linear feedback control. For this reason, the example without track generation of FIG. 18 shows a large overshoot and generates vibration different from the mechanical resonance frequency of the mechanism, which worsens convergence to the target position. In contrast, the example with track generation is a track generator that suppresses the mechanical resonance frequency by the low-pass filter and generates the target track position so as to suppress voltage or current saturation. Consequently, vibration by the mechanical resonance frequency is suppressed, and positioning performance to the target position by the feedback control can be improved.

When the configuration of the present embodiment is used for a secondary transfer unit of an image forming apparatus, and such response as the example without track generation of FIG. 18 is performed, fluctuations of the transfer pressure of the secondary transfer may increase, changes may occur in characteristics for transferring toner images from an intermediate body to a sheet, and faulty transfer such as image density unevenness may occur. In contrast, such response as the example with track generation is performed, thereby reducing the fluctuations of the transfer pressure and enabling the toner images to be stably transferred from the intermediate transfer body to the sheet.

As can been seen from FIG. 18, when the track generation is performed, the position deviation immediately after changing the target position is small, the operation amount from the compensator is small, and the start of operation of the object to be controller is delayed. This delay means that the time from a separate state to a contact state is delayed and that start-up of the transfer pressure is also delayed. These delays can be adjusted by advancing timing when the target position is changed.

The embodiments as described above produce an effect of setting force acting on a part that can come close to or separate from an object with high precision and good responsiveness.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

The invention claimed is:

1. A pressing apparatus comprising:

a presser including a second member configured to come close to or separate from a first member;

an elastic member configured to apply force in a direction in which the second member comes close to the first member to the presser, the elastic member being mounted on the presser;

an actuator configured to apply force in a direction in which the second member comes close to the first member and separates from the first member to the presser to adjust pressure between the second member and the first member during a printing operation by controlling a gap between the second member and the first member, the actuator being mounted on the presser;

an acquirer configured to acquire a parameter containing at least one of a position of the presser, a speed of the presser, and force applied by the actuator to the presser; and a controller configured to feedback-control the actuator based on the acquired parameter.

2. The pressing apparatus according to claim 1, wherein the presser has a swingable member configured to swing about a fulcrum to cause the second member to come close to or separate from the first member, the second member, the elastic member, and the actuator being mounted on the swingable member, and a distance between a position at which the actuator is mounted on the swingable member and the fulcrum of the swingable member is longer than a distance between a position at which the second member is mounted on the swingable member and the fulcrum of the swingable member.

3. The pressing apparatus according to claim 2, wherein the actuator is a rotary actuator mounted on an end of the swingable member and transmits torque to the swingable member to apply force in the direction in which the second member comes close to the first member and separates from the first member to the presser.

4. The pressing apparatus according to claim 1, wherein the acquirer acquires the parameter containing the position of the presser.

5. The pressing apparatus according to claim 1, wherein the acquirer acquires the parameter containing the speed of the presser.

6. The pressing apparatus according to claim 1, wherein the actuator is driven by electricity, the acquirer acquires a current flowing through the actuator to acquire the parameter containing the force applied by the actuator to the presser, and the controller feedback-controls the current flowing through the actuator.

7. The pressing apparatus according to claim 1, further comprising a track generator configured to, when a target position for controlling the actuator for causing the second member to come close to or separate from the first member is changed from a first target position to a second target position, connect between the first target position and the second target position in time series and generate a target track position as a new target position of the controller.

8. The pressing apparatus according to claim 7, wherein the track generator is a numerical operation filter.

9. An image forming apparatus comprising:

a first member including an intermediate transfer body on which an image is formed; and the pressing apparatus according to claim 1, wherein the second member is pressed against a sheet arranged in between the second member and the first member and transfers the image formed on the first member to the sheet.

10. The image forming apparatus according to claim 9, further comprising a sheet information acquirer configured to acquire a thickness of the sheet, wherein the controller controls the actuator based on the thickness of the sheet to enable the second member to come close to or separate from the first member.

11. The image forming apparatus according to claim 1, further comprising a cam that rotatably contacts a surface of the presser.

12. The image forming apparatus according to claim 1, wherein the presser includes at least one beam disposed between supporting members of the presser and the actuator is fixed to the at least one beam.

13. The image forming apparatus according to claim 1, wherein the actuator is an actuating motor that applies force directly to the presser in a direction in which the second member comes close to the first member and separates from the first member to the presser.

14. A method for controlling a pressing apparatus that includes a presser including a second member configured to come close to or separate from a first member, an elastic member configured to apply force in a direction in which the second member comes close to the first member to the presser, the elastic member being mounted on the presser, and an actuator configured to apply force in a direction in which the second member comes close to the first member and separates from the first member to the presser, the actuator being mounted on the presser, the method comprising:

acquiring a parameter containing at least one of a position of the presser, a speed of the presser, and force applied by the actuator to the presser; and feedback-controlling the actuator based on the parameter to adjust pressure between the second member and the first member during a printing operation by controlling a gap between the second member and the first member.

15. A non-transitory computer-readable storage medium with an executable program stored thereon and executed in a computer of a pressing apparatus that includes a presser including a second member configured to come close to and separate from a first member, an elastic member configured to apply force in a direction in which the second member comes close to the first member to the presser, the elastic member being mounted on the presser, and an actuator configured to apply force in a direction in which the second member comes close to the first member or separates from the first member to the presser, the actuator being mounted on the presser, wherein the executable program instructs the computer to perform:

acquiring a parameter containing at least one of a position of the presser, a speed of the presser, and force applied by the actuator to the presser; and feedback-controlling the actuator based on the parameter to adjust pressure between the second member and the first member during a printing operation by controlling a gap between the second member and the first member.

* * * * *